US010036608B2

(12) United States Patent
Hunt

(10) Patent No.: US 10,036,608 B2
(45) Date of Patent: Jul. 31, 2018

(54) WEAPON EMULATORS, AND SYSTEMS AND METHODS RELATED THERETO

(71) Applicant: Jon E. Hunt, West Hills, CA (US)

(72) Inventor: Jon E. Hunt, West Hills, CA (US)

( * ) Notice: Subject to any disclaimer, the term of this patent is extended or adjusted under 35 U.S.C. 154(b) by 891 days.

(21) Appl. No.: 14/217,193

(22) Filed: Mar. 17, 2014

(65) Prior Publication Data

US 2014/0272806 A1 Sep. 18, 2014

Related U.S. Application Data

(60) Provisional application No. 61/799,941, filed on Mar. 15, 2013.

(51) Int. Cl.

| | |
|---|---|
| ***F41A 33/02*** | (2006.01) |
| ***F41A 33/00*** | (2006.01) |
| ***F41A 33/06*** | (2006.01) |
| ***A63H 33/30*** | (2006.01) |

(52) U.S. Cl.

CPC ..... *F41A 33/02* (2013.01); *A63H 33/30* (2013.01); *F41A 33/00* (2013.01); *F41A 33/06* (2013.01)

(58) Field of Classification Search

CPC ..... G09B 19/00; F41A 33/00; F41A 33/02; F41A 33/04; F41A 33/06; F41G 3/2622; A63H 33/30

USPC ..... 434/16

See application file for complete search history.

(56) References Cited

U.S. PATENT DOCUMENTS

| | | | | | |
|---|---|---|---|---|---|
| 4,240,056 | A * | 12/1980 | Mayer | H01F 7/1638 | 335/267 |
| 4,290,219 | A * | 9/1981 | Boller | F41A 33/00 | 346/38 |
| 5,569,085 | A * | 10/1996 | Igarashi | A63F 9/0291 | 434/18 |
| 5,735,070 | A * | 4/1998 | Vasquez | F41G 1/345 | 42/1.02 |
| 5,947,738 | A * | 9/1999 | Muehle | F41A 33/02 | 124/57 |
| 2008/0233543 | A1* | 9/2008 | Guissin | F41A 33/00 | 434/19 |
| 2011/0306020 | A1* | 12/2011 | Peterson | F41A 33/06 | 434/18 |
| 2015/0108215 | A1* | 4/2015 | Ehrlich | G01S 17/88 | 235/404 |

OTHER PUBLICATIONS http://www.imdb.com/title/tt0086250/trivia; Scarface (1983)—Trivia—IMDb; pp. 1-5.

http://www.freewebs.com/scarface50/scarfacebehinddascene.htm; website frozen.

* cited by examiner

*Primary Examiner* — Timothy A Musselman

(74) *Attorney, Agent, or Firm* — Hackler Daghighian Martino & Novak

(57) ABSTRACT

A weapon emulator comprising: a body; an electro-mechanical actuator coupled to the body; a firing indicator coupled to the electro-mechanical actuator and designed to move relative to the body when the electro-mechanical actuator is activated.

20 Claims, 9 Drawing Sheets

WEAPON EMULATORS, AND SYSTEMS AND METHODS RELATED THERETO

CROSS-REFERENCE TO RELATED APPLICATION

This application claims the benefit of U.S. Provisional Application No. 61/799,941, filed Mar. 15, 2013, which is hereby incorporated by reference in its entirety.

FIELD

The present patent document relates to weapon emulators and systems and methods related thereto. More particularly, the present patent document relates to weapon emulators for use with movie or film making and the systems and methods related thereto.

BACKGROUND

Firearms used in movies (or TV, theatre, or similar areas of the entertainment industry) represent several concerns, chief among them being safety, legal, and cost. In order to obtain the ultimate in realism as required by modern movies, real guns modified to fire blanks are used, which in a number of cases has resulted in death (i.e. Brandon Lee, Jon-Erik Hexum, etc.) and injury (i.e. Al Pacino burning his hand on a hot gun barrel during the filming of Scarface, etc.).

Blanks comprise an explosive such as gunpowder, which can be harmless from as close as three feet away, but can have a dangerous or even deadly impact up close. While the powder from blanks disperses quickly, if a firearm is pressed against an object, even the blank will cause devastating damage similar to if an actual bullet was used. Firing the wrong type of blank can also cause serious injury.

In addition to the physical dangers, using real guns and blanks on a movie set comes with a number of legal issues. The Bureau of Alcohol, Tobacco and Firearms (BATF) regulates every aspect of firearm use. These regulations become even more onerous with the use of "killing weapons" such as machine guns and the like. Unfortunately, these types of "killing weapons" are often very desirable for movie makers because of their fantasy aspect. Among other things, BATF limits who on the set can legally interact with guns, as well as the burden to ensure that the regulatory paperwork is fully correct.

There are also a number of cost issues associated with using real guns in movies. To begin with, there is the ongoing cost of "consumables" (i.e. blanks, squibs, etc.). Gun use on movie sets also often results in higher insurance rates. In addition, the potential for lawsuits from misuse of guns is increased. The use of real guns in movies requires additional qualified personnel on the payroll (i.e. gun wrangler, weapons handler, etc.), which increases costs. Real guns require enhanced security for storage and transportation, which all increase costs and cut from the bottom line.

In addition to the already mentioned problems, there are a number of practical issues with the use of real guns on movie sets. Blanks do not always fire properly and multiple "takes" due to reduced reliability from fractional-load blanks (i.e. misfires, jams, partial or non-operation of slide/bolt, etc.) are inevitable. When movies are being filmed on location, depending on the location of the set, there often exist noise regulations that restrict when filming scenes involving the use of guns and blanks may occur.

Accordingly, a replacement for the use of real guns on the sets of movies, film, theater and other endeavors is needed.

SUMMARY OF THE EMBODIMENTS

In view of the foregoing, an object according to one aspect of the present patent document is to provide weapon emulators, systems for using weapon emulators, and methods related thereto. Preferably the methods and apparatuses address, or at least ameliorate, one or more of the problems described above. To this end, a weapon emulator is provided. In one embodiment, a weapon emulator comprises: a body; an electro-mechanical actuator coupled to the body; and a firing indicator coupled to the electro-mechanical actuator and designed to move relative to the body when the electro-mechanical actuator is activated. In a preferred embodiment, the weapon emulator further comprises a wireless communication interface.

In a preferred embodiment, the electro-mechanical actuator is a solenoid motor. In some of those embodiments, the solenoid motor comprises multiple stages.

In many embodiments, the weapon emulator has the appearance of a firearm. In some of the embodiments where the weapon emulator has the appearance of a firearm, the firing indicator is a slide. In some embodiments including a slide, the electro-mechanical actuator is designed to move the slide at least one inch relative to the body. In other embodiments, the slide may move at least 1.25 inches, 1.5 inches, 1.75 inches or even 2 inches or more.

In some embodiments, the weapon emulator further comprises a shell ejection mechanism. In some of those embodiments, the shell ejection mechanism includes an electro mechanical actuator designed to eject a shell casing.

In some embodiments, the weapon emulator further comprises a barrel tip indicator. In some embodiments with a barrel tip indicator, the barrel tip indicator is an LED.

A preferred embodiment of a weapon emulator further comprises a trigger wherein movement of the trigger causes the electro-mechanical actuator to activate.

In another aspect of the embodiments disclosed herein, a weapon emulator is provided comprising: a body; an electro-mechanical actuator coupled to the body; a firing indicator coupled to the electro-mechanical actuator; and electronics designed to synchronize the activation of the electro-mechanical actuator with the operation of a camera and/or timing of a camera frame.

In yet another aspect of the embodiments disclosed herein a method of emulating the visual appearance of a weapon firing is provided. A preferred embodiment comprises the steps of: receiving a fire signal; activating an electro-mechanical actuator coupled to a body of a weapon emulator; and causing a firing indicator coupled to the electro-mechanical actuator to move relative to the body of the weapon emulator.

A preferred embodiment of the method further comprises the step of pulling a trigger to create a fire signal. Some embodiments further comprise the step of causing a barrel tip indicator to illuminate.

In yet another aspect of the embodiments disclosed herein a system for filming a movie is provided. Preferred embodiments of a system for filming a movie comprise: a weapon emulator comprising a firing indicator and a wireless interface; and a system controller including a wireless interface designed to communicate with the weapon emulator.

Some embodiments of the system further comprise a handheld controller with a wireless interface designed to communicate with the system controller. Some embodiments of the system further comprise a camera wherein the camera is in communication with the system controller. Some embodiments of the system further comprise a squib wherein the activation of the squib is coordinated with the activation of the weapon emulator by the system controller. Preferred embodiments of the system further comprise audio equipment in communication with the system controller.

In yet another aspect of the embodiments disclosed herein, a method for synchronizing the activation of a weapon emulator to a camera is provided. Preferred embodiments of a method for synchronizing the activation of a weapon emulator to a camera comprise the steps of: activating the weapon emulator; using a trigger on the weapon emulator as a gate to indicate activation of the weapon emulator; activating an electro-mechanical actuator coupled to a body of a weapon emulator; and causing a firing indicator coupled to the electro-mechanical actuator to move relative to the body of the weapon emulator during a next full frame count of the camera.

In yet another aspect of the embodiments disclosed herein, a method for automatically inserting audio and visual effects into film frames is provided. Preferred embodiments of such methods comprise the steps of: activating a weapon emulator; creating a digital time-tagged data file containing sound and visual markers for a time and location in the film that the weapon emulator was activated; using software to locate the sound and visual markers; and using software to insert the corresponding sound and visual effects from a pre-recorded firearm effects library.

In some embodiments of the method, the location that the weapon emulator is activated is designated by a barrel tip locator.

In yet another aspect of the embodiments disclosed herein a film created by the process described herein is provided. In preferred embodiments of the film, the film is created with a process comprising the steps of: causing a an electro-mechanical actuator to move a firing indicator on a weapon emulator relative to a body of the weapon emulator; capturing the movement of the firing indicator on film; and editing the film in post-production to add both a sound effect and a visual effect.

In some embodiments of the film of the processes described herein, the process further comprises the step of: synching the movement of the firing indicator with a camera frame.

As described more fully below, apparatuses, systems, and methods comprising a weapon emulator are provided. Further aspects, objects, desirable features, and advantages of the apparatuses, systems and methods disclosed herein will be better understood from the detailed description and drawings that follow, in which various embodiments are illustrated by way of example. It is to be expressly understood, however, that the drawings are for the purpose of illustration only and are not intended as a definition of the limits of the claimed invention.

DETAILED DESCRIPTION OF THE EMBODIMENTS

Figure 1:
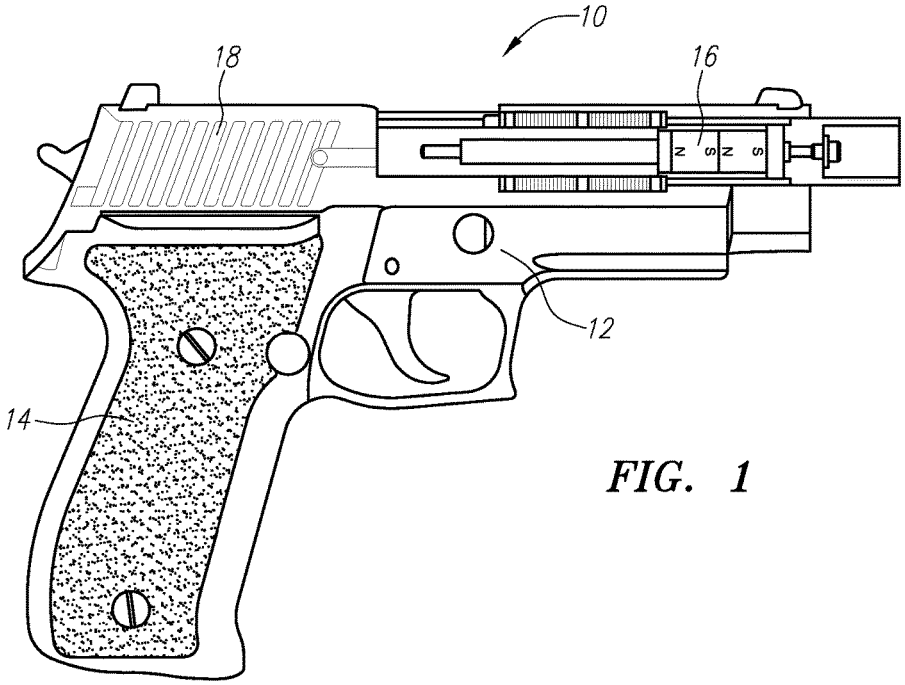
FIG. 1 illustrates one embodiment of a weapon emulator with a cutout exposing the electro-mechanical actuator.

The embodiments of the present patent document create an instrument that looks and acts like a weapon, such as a gun, without actually being a weapon, and without the negatives cited above. In preferred embodiments, the weapon emulator is a micro-controlled, electro-mechanically actuated alternative to the traditional blank-adapted firearm used in movies, television, theatre and similar areas of the entertainment industry, as well as gaming development and military & law enforcement training. In preferred embodiments, the weapon emulator emulates a "real" weapon in three areas: Mechanical Operation, Muzzle Flash, and Gun Shot Sound. A fourth area, Controls & Interfaces, deals with integrating with the outside world.

In one embodiment, a weapon emulator may be accomplished with the following steps: First, machine out of metal the major components of the firearm (i.e. upper slide/bolt and lower frame/receiver) such that the external appearance is a precise replica of the real gun, but the internal configuration is not (i.e. fire control components cannot be installed, etc., thereby avoiding any legal or regulatory issues). In a preferred embodiment, the major components may be machined out of aluminum but in other embodiments, other metals may be used. In addition, casting, molding or other forms of manufacture may be used for creating the major components of the weapon.

Second, install an electro-mechanical actuator. The electro-mechanical actuator is preferably installed in place of the barrel/chamber or guide rod but may be installed anywhere within the body. Accordingly, the explosive propellants associated with real/blank ammunition are replaced with an inherently safe mechanism for moving the slide/bolt when the trigger is pressed (i.e. there are no projectiles or hot gases of any kind and the barrel is not even capable of releasing such substances).

Third, install electronics for driving the electro-mechanical actuator at a realistic speed. In a preferred embodiment, the electronics are comprised of a microcontroller and associated support circuitry. However, in other embodiments, other types of electronics may be used and the electronics may provide other functionality such as wireless communications and the like.

In a preferred embodiment, the electronics are powered by batteries and in an even more preferred embodiment, high pulse current capable Lithium-Polymer batteries may be used. In a preferred embodiment, a plurality of batteries are used and connected in series for higher voltage. The batteries may be in any form factor and may be connected in other electrical configurations.

Lastly, a preferred embodiment may also include a magazine that ejects an empty shell at the right time following a trigger pull.

In another aspect of the present patent document, an embodiment of a system is provided where the operation of the weapon emulator(s) is/are fully integrated with cameras, all under the control of a single individual armed with a handheld controller that is capable of running the controlling application. In a preferred embodiment, the handheld controller is a tablet. In another preferred embodiment, the handheld controller is a smartphone (i.e. iPhone, etc.). In yet other embodiments, other types of control devices may be used such as a laptop, desktop or other type of computer.

In a preferred embodiment, the individual controlling the system has wirelessly micro-adjustable control over when the weapon emulator "fires" on a frame-by-frame basis (programmed to optimize how the weapon emulator operation looks on film), and be able to configure the modes of operation of each weapon emulator used in the scene. In a preferred embodiment, all possible modes of operation are included in the firmware pre-loaded onto the embedded controller, and the desired operation is selected at any time, as needed, by the individual operating the controller.

In different embodiments, different modes of operation may be included. As non-limiting examples, modes of operation may include single-shot, fully automatic, 3-round burst, N-round burst (where a number N rounds of gunfire are fired in succession), machine pistol, double-tap intervals, programmed rate of fire, Semi-to-Auto conversion and programmed misfires. For each mode of operation, trigger operation may be detected with a solid-state sensor, resulting in a full actuation cycle of the slide/bolt, and simulating a pattern of gunfire shots depending on the mode of operation.

In preferred embodiments, the system coordinates the weapon fire with corresponding body-hit squibs. In some embodiments, the individual using the controller may assign each simulated gun shot to its corresponding body-hit squibs (thus eliminating timing problems associated with manual squib initiation), coordinate the on-set sounds of gunfire through an audio processor (for "silent" operation, low-volume gunshots as a feedback aid to the actors, or full-volume gunshots if desired and local noise regulations allow), and set up the generation of a digital file representing the real-time operation of all firearms on the set. In a preferred embodiment, the digital file is used in post-production editing to automatically locate the correct film frames for insertion of sound and flashes. In other embodiments, other capabilities may be added.

In a preferred embodiment, a fully functional alternative to the traditional firearms currently used in movies is provided. From the perspective of the movie-viewer, these proposed "fake" firearms will be indistinguishable in operation from "real" firearms, while the movie-maker will see significant safety improvements, elimination of negative legal issues, and reduced production cost. Additionally, the design of both the firearm and the larger system of which it is a part may enable vast improvements in other aspects of movie-making, television, theatre, and similar areas of the entertainment industry. The embodiments of the system disclosed herein also may be used in video game production and law enforcement and military training and any other area where gun fire replication may be needed.

To this end, FIG. 1 illustrates a weapon emulator 10. As used herein, the word "weapon" may refer to any device designed to inflict harm or protect, including but not limited to: guns, firearms, bows, cross-bows, grenade launchers, rocket launchers, Gatling guns, machine guns, Uzis, or any other type of weapon. In a preferred embodiment, "weapon" refers to a device designed to launch a projectile. In an even more preferred embodiment, "weapon" refers to a device designed to launch a projectile using an explosion caused from gunpowder or a similar explosive. "Weapon" includes both handheld weapons and weapons mounted on vehicles including cars, motorcycles, trucks, boats, ships, planes, helicopters, or any other vehicles. In a preferred embodiment, a weapon refers to a handheld firearm.

A "weapon emulator" may be any device designed to emulate a weapon. In a preferred embodiment, a "weapon emulator" can simulate the appearance of a weapon being fired. In particular, a "weapon emulator" includes a weapon prop designed to simulate a weapon in a movie. In a preferred embodiment, a weapon emulator may simulate the appearance of a weapon being fired in a movie. In some embodiments, a weapon emulator may be made from a real weapon. In creating a weapon emulator from a real weapon, some portions of the real weapon may be removed or modified. Once the real weapon has been modified, it preferably no longer functions as a working weapon but retains the capability to simulate the appearance of a working weapon.

In some embodiments, a weapon emulator may comprise portions of a real weapon. For example, outer portions of the body or casing of a real weapon may be attached over a weapon emulator body to add authenticity to the appearance of the weapon emulator. In yet other embodiments, a weapon emulator may be fabricated completely from scratch.

A weapon emulator may be made from any material. The individual parts of a weapon emulator do not all have to be made from the same material. In a preferred embodiment, the weapon emulator may be made from materials similar to the materials used to construct the real weapon. In embodiments where the weapon emulator is designed to simulate a gun, the weapon emulator may be made from metal such as steel, or stainless steel. However, in other embodiments, a weapon emulator may be made from other metals such as aluminum, brass, nickel, titanium, or any other metal. In yet other embodiments, a weapon emulator may be made from plastic, rubber, ceramic, wood, or any other suitable material. In yet other embodiments, advanced synthetic polymers may be used. In a preferred embodiment, where the weapon emulator is designed to simulate a firearm, the weapon emulator may be machined from aluminum using computer numerical control (CNC). In a preferred embodiment, the weapon emulator is machined to exactly replicate the external appearance of the firearm being replicated. In yet other embodiments, casting, molding, forging or any other type of manufacture may be used.

The weapon emulator 10 shown in FIG. 1 comprises a body 12. The body 12 of the weapon emulator is designed to provide structure to the weapon emulator 10. In the embodiment shown in FIG. 1, the body 12 comprises a handle 14. The handle allows the hand-held weapon emulator shown in FIG. 1 to be held by a human hand. In a preferred embodiment, the body 12 and firing indicator 18 (or lower and upper receiver, as the case may be) are machined out of a solid billet of aluminum, per a detailed 3 dimensional CAD model representation of the firearm.

Figure 2:
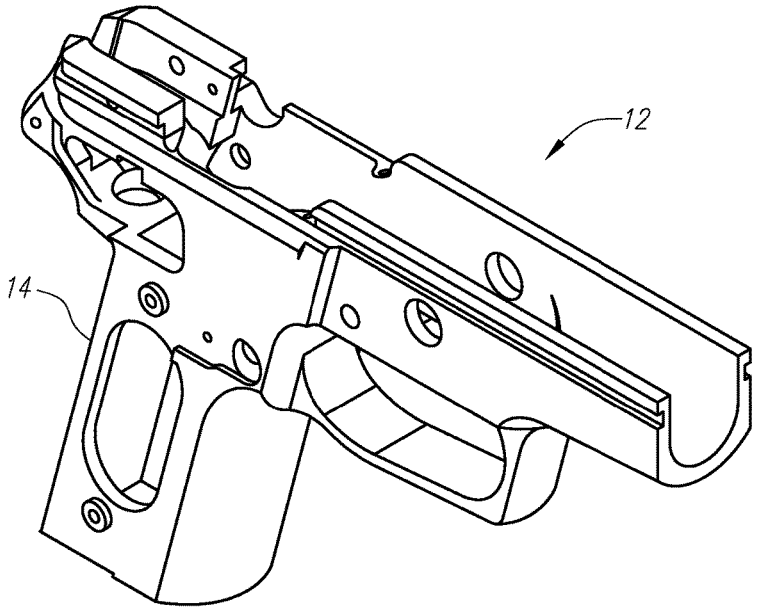
FIG. 2 illustrates an isometric view of one embodiment of a 3 dimensional CAD model of a body for use in a weapon emulator.

FIG. 2, illustrates an isometric view of one embodiment of a 3 dimensional CAD model of a body 12 for use in a weapon emulator 10. The body 12 shown in FIG. 2 is designed to emulate a Sig Sauer P228. However, in other embodiments, other weapons or firearms may be replicated. Using 3D CAD models allows a perfect or near perfect replication of the external appearance of the firearm, while providing for an internal volume of space with various mounting locations to house the electro-mechanical actuator 16, electronics 20, power supply 26, and related components. In other embodiments, other methods of manufacture may be employed. Regardless of the method of manufacture, preferably the weapon emulator 10 looks as close as possible on the outside to the weapon it is trying to emulate.

Returning to FIG. 1, the weapon emulator 10 further comprises an electro-mechanical actuator 16. The electro-mechanical actuator 16 is coupled to the body 12. In a preferred embodiment, the electro-mechanical actuator 16 is a solenoid motor. In an even more preferred embodiment, the electro-mechanical actuator 16 is a multi-stage solenoid motor. A multi-stage solenoid motor is used for high-force and minimum drive count (2-3 stages for typical short-stroke operation), utilizing moving coils to minimize the overall mass of assembly under motion. In other embodiments, the electro-mechanical actuator 16 is a fixed magnet with moving coil or coils driven as a single solenoid or voice coil. In yet another preferred embodiment, the electro-mechanical actuator 16 is an alternating-pole magnet assembly with multiple coils driven as stepper motor.

In most embodiments, the electro-mechanical actuator 16 provides linear motion. In a preferred embodiment a direct linear actuator comprised of a series-connected voice coil motor, or "multi-solenoid" is used, wherein position feedback is provided by a microcontroller to advance the firing indicator 18 slide (or bolt) in either direction. This is accomplished by selectively applying drive waveforms to sequential coils acting upon a rotor made up of a single rare-earth magnet, whose dimensions are matched for this purpose with the individual coil lengths.

In embodiments where the firing indicator 18 is a slide, the required motion is linear, and may be achieved by a purely linear motor, or through the use of translational mechanical linkages to convert a rotary motor to a linear motion. Position feedback may be used by a microcontroller to advance the slide/bolt in either direction by selectively applying drive waveforms to sequential coils acting upon a rotor made up of a single rare-earth magnet, whose dimensions are matched with the individual coil lengths.

In other embodiments, the electro-mechanical actuator 16 may be any type of electro-mechanical actuator, including a linear stepper motor, a plurality of linear stepper motors, a lead screw or other linear actuator designs, or any other type of electro-mechanical actuator.

In a preferred embodiment, a position sensor or sensors may function to provide feedback to the embedded controller for the purpose of moving the firing indicator 18 in a more precise and realistic manner. Position sensors may include: 1.) Simple end-of-stroke switches that detect when the firing indicator 18 is in the chamber (forward or ready) position or in the ejection (rearward) position. The electro-mechanical actuator 16 may be driven open-loop between these two positions. 2.) Digital or Analog Hall Effect switches located between the individual coils to detect the presence of the leading or trailing edge of the magnet. With the magnet location known relative to the coils, the electro-mechanical actuator 16 may be driven closed-loop. 3.) Linear Magnetic Scale technique utilizing a magnetic stripe with alternating poles acting upon a specialty integrated circuit that detects the magnetic pattern and converts it to a precise measurement of absolute location, enabling motion control at very fine resolutions. In yet other embodiments, any of several methods may be used to sense position utilizing magnetic, optical, inductive, capacitive, resistive, mechanical, and other techniques. In a preferred embodiment, integrated Hall Sensors are included for position feedback to the controller, and integrated temperature sensors are included for real-time thermal overload monitoring.

The weapon emulator 10 shown in FIG. 1 further comprises a firing indicator 18. The firing indicator 18 is coupled to the electro-mechanical actuator 16. A "firing indicator" as used herein is any visible portion of a weapon emulator 10 that is moved relative to the body 12 of the weapon emulator 10 when the weapon emulator is simulating the firing of the weapon. Accordingly, the firing indicator 18 is coupled to the electro-mechanical actuator 16 such that when the electro-mechanical actuator 16 is activated, the firing indicator 18 moves relative to the body 12 of the weapon emulator 10 to visually emulate the firing of the weapon. In various different embodiments, the firing indicator 18 may be any portion of the weapon emulator 10 that moves relative to the body 12 when the electro-mechanical actuator 16 is activated. In preferred embodiments, the firing indicator 18 may be a slide, bolt, hammer, cylinder or any other externally visible part of the weapon emulator 10 that needs to move to visually simulate the firing of a real weapon.

The slide is the part of the weapon on a majority of semi-automatic pistols that moves during the operating cycle and generally houses the firing pin or striker and the extractor, and serves as the bolt. A bolt on a rifle may be thought of as performing the same function. The slide is typically spring-loaded so that once it has moved to its rearmost position in the firing cycle, spring tension brings it back to the starting position, chambering a fresh cartridge during the motion, provided that the magazine is not empty.

Through the principles of recoil or blowback operation, the slide is forced back with each shot. Generally, this action serves three purposes: ejecting the spent casing, cocking the hammer or striker for the next shot, and loading another cartridge into the chamber when the slide comes forward.

Once the magazine is empty, the slide will lock back, and is released only when the slide stop is depressed; if a new magazine is inserted before the slide stop is depressed, then a new cartridge will be chambered. Automatically cocking the hammer or striker is an important function of double action and single action pistols. However, some semi-automatic pistols are double action only, and are designed to omit this step of cocking the hammer or striker. In the embodiment shown in FIG. 1, the firing indicator 18 is shown as a slide.

The cylinder is the cylindrical, rotating part of the weapon on revolvers that moves during the operating cycle. The cylinder contains multiple cartridge chambers. The hammer in a revolver is spring-loaded and positioned on the other side of the cylinder from the barrel, in line with the barrel. A revolver is operated by cocking the hammer back, which lines up a new cartridge in between the hammer and the barrel, and then releasing the hammer by pulling the trigger. The spring throws the hammer forward so that it hits the primer, which explodes, igniting the propellant, and driving the bullet down the barrel.

A firing indicator 18 is some portion of the weapon emulator 10 visible on the outside of the weapon emulator 10 such that when the firing indicator 18 moves relative to the body 12, the weapon emulator 10 visually simulates the appearance of the firing of a real weapon. For example, when a pistol is fired, the slide or bolt on the pistol moves back away from the barrel of the gun relative to the body and recoils. In another embodiment, the firing indicator 18 may be the hammer. In a pistol, the hammer moves back and rapidly returns forward when the gun is fired. In yet another preferred embodiment, the firing indicator is a cylinder. For example, in a six-shooter revolver, the cylinder portion of the gun that holds the six bullets may also rotate during the cocking of the gun. To this end, the firing indicator 18 is any portion of the weapon emulator 10 that moves relative to the body 12 in order to allow the weapon emulator 10 to visually provide the appearance of a real weapon being fired.

To this end a firing indicator 18 may include a slide, bolt, hammer, cylinder, or any other portion of a weapon emulator 10 visually mimicking the firing of a real weapon. Of course, the component acting as a firing indicator 18 on a weapon emulator 10 is not required to provide any of the functionality of the corresponding component on a real weapon, and may only be placed in motion by the electro-mechanical actuator 16 to allow the weapon emulator 10 to replicate the visual appearance of a firing weapon.

Although the firing indicator 18 is designed to mimic the appearance of the firing of a real weapon, in some embodiments, the firing indicator 18 may not perform exactly like its real counterpart on a real gun. For example, in some embodiments, the firing indicator 18 on the weapon emulator 10 may not move relative to the body 12 as fast as its real counterpart on a real gun. Because the weapon emulator 10 provides software control over the firing indicator 18, the firing indicator 18 may move in an almost unlimited number of ways including: 1.) moving backward and forward rapidly, to simulate the effect of a firearm being fired; 2.) moving backward and forward at a controlled rate, to accomplish some effect not available with a real firearm; 3.) moving backward and forward in a discontinuous manner, in order to demonstrate a simulated malfunction; 4.) moving backward and forward in a synchronized manner, such that the firearm is time-aligned with some external event; and 5.) moving backward and forward as needed to accomplish the requirements of the user.

The inclusion of a micro-controlled electro-mechanical actuator 16 as the basis for weapon emulator operation enables the implementation of any conceivable motion through software code development. With sufficient memory resources, all possible modes of operation may be preloaded onto the embedded controller, and the desired operation may be selected at any time, as needed, by the actor or crew member.

In a preferred embodiment, the firing indicator 18 is a slide. In an embodiment where the firing indicator 18 is a slide, the body 12, firing indicator 18, and electro-mechanical actuator 16 are arranged such that the firing indicator 18 may be rapidly moved in one direction relative to the body 12 and then recoil back to its original position. Preferably, this visually mimics the appearance of a slide or bolt on a real gun.

In another preferred embodiment, the firing indicator 18 may be a cylinder. In an embodiment where the firing indicator 18 is a cylinder, the body 12, firing indicator 18, and electro-mechanical actuator 16 are arranged such that the firing indicator 18 rotates from one chamber to the next chamber, in one direction relative to the body 12. Preferably, this visually mimics the appearance of a cylinder on a real gun.

In yet another embodiment, the firing indicator 18 may be a hammer. In such an embodiment, the firing indicator 18 may retract from the body 12 and return with each firing. Preferably, this visually mimics the appearance of a hammer on a real gun. In yet other embodiments, different firing indicators 18 may be combined. As a non-limiting example, a firing indicator 18 designed to mimic a cylinder and a firing indicator 18 designed to mimic a hammer may be combined in a single weapon emulator 10.

Figure 3:
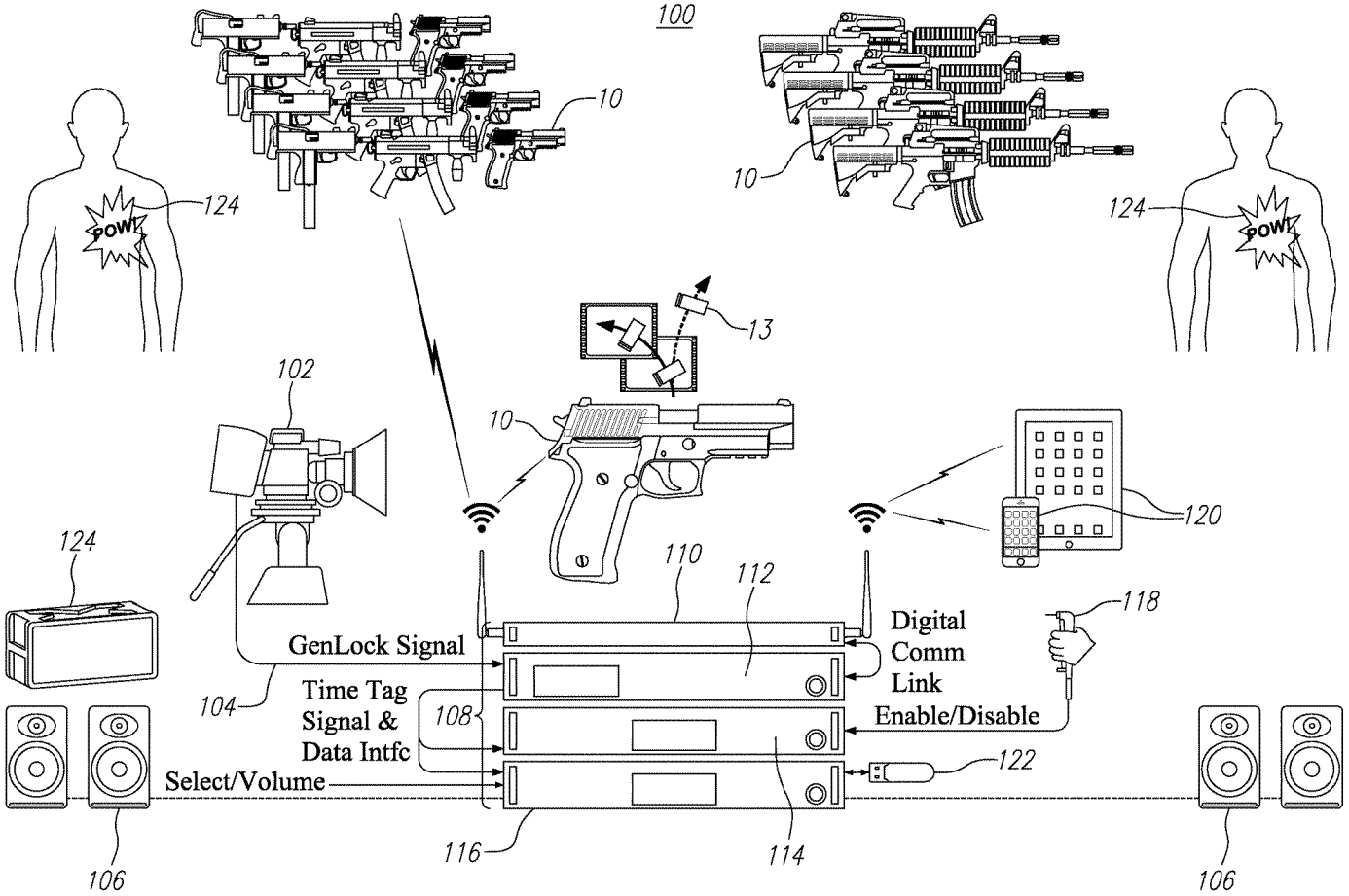
FIG. 3 illustrates a system including a weapon emulator.

FIG. 3 illustrates a system 100 including a weapon emulator 10 and additional supporting components. While a weapon emulator 10 may be used as a standalone unit, whose operational features are configured by manipulating various multi-purpose levers and buttons on the gun itself, in a preferred embodiment, weapon emulator 10 is designed to be used in a system 100. The system 100 may vastly expand the features and benefits available from using the weapon emulator 10, especially in the field of movie making. The stand-alone weapon emulator 10 may be used alone or may be configured through firmware updates to integrate with a larger system 100. Firmware updates may be used to add any type of additional feature or functionality to weapon emulator 10.

At the heart of the system 100 is the System Controller 108. The System Controller 108 communicates with the weapon emulator 10 and in preferred embodiments, coordinates many of the functions of the weapon emulator 10. The System Controller 108 may be a single unit or be made up of multiple units. In the embodiment shown in FIG. 3, the System Controller 108 is made up of a Wireless Interface 110, Firearm Controller 112, Pyro Fx Controller 114, and Sound Fx Controller 116. In other embodiments, these functions may be provided in fewer units. For example, different level units may be created that are designed to handle all the functions of a certain number of weapon emulators 10. For example, a "MID" level system may be a compact single box controller which supports the wirelessly frame-synchronized operation of up to four weapon emulators 10. Other custom "level" systems may be created and they may be stacked or used in combination to build systems capable of handling larger numbers of weapon emulators 10 or specific features.

As may be seen in FIG. 3, multiple weapon emulators 10 may be used in a system 100. The weapon emulators 10 may be of various types and kinds including hand guns, machine guns, assault rifles or any other type of weapon emulator 10. In some embodiments, one or more of the weapon emulators 10 may be connected to the System Controller 108 through cables. However, in a preferred embodiment, the System Controller 108 includes a wireless interface and the weapon emulators 10 communicate with the System Controller 108 via the wireless interface 110.

In a preferred embodiment, the wireless link may support multiple wireless communication protocols. However in other embodiments, a single wireless protocol may be used. Wireless interface 110 may support Bluetooth, WiFi (IEEE 802.11), 3G, 4G, LTE, a custom and/or proprietary wireless link, or any other type of wireless protocol. In the system shown in FIG. 3, the wireless interface 110 uses a multi-channel ultra-low latency wireless link to communicate with the weapon emulators 10. The wireless link may be encrypted or proprietary in order to prevent inadvertent actuation by an unauthorized source, thereby increasing safety. The wireless interface 110 may receive pre and post-use status reports from the weapon emulators 10. In addition, the wireless interface 110 may receive real-time low latency time tags of firearm operational events. These may be later used by the system 100 for post-production work as discussed later in this document. In yet other embodiments, the wireless interface 110 may receive other messages from the weapon emulators 10 including but not limited to Sync confirm, trigger active, self-test or system test requests or results, or any other type of operational message.

The wireless controller 110 may also send information to the weapon emulators 10. As just a few examples, the wireless controller 110 may send a status request, self-test request, configuration file update, firmware update, initiate sync or re-sync, or a fire command to name a few.

In addition, the wireless interface may communicate with handheld controllers 120. In the embodiment shown in FIG. 3, Bluetooth is used to communicate with the handheld controllers 120. Bluetooth may be preferable because of its low power consumption and broad range of compatible devices. Handheld controllers 120 may be a phone, tablet, laptop or any other type of portable communication device that allows a remote user to communicate with the system 100 and preferably the System Controller 108. Handheld controllers 120 may include a custom piece of software such as an "app" to aid in running system 100. Preferably, handheld controllers 120 have a graphical user interface (GUI), that allows a person to interface with the system 100. In a preferred embodiment, handheld controllers 120 may interface with the system in real time such that handheld controllers 120 always show current information.

In a preferred embodiment, all available system features are accessible and configurable through a convenient GUI on the handheld controller 120. As just a few examples, a user may use a handheld controller 120 to wirelessly connect with the System Controller 108 and perform setup and configuration of the system 100 as well as getting and monitoring the status of all components including the weapon emulators 10. As another example, a user may set the firing mode of any weapon emulator 10. Firing modes may include but are not limited to single-shot, multi-shot, full-auto and burst. Status of the system 100 may include performing an initial built in self-test (BiST), battery capacity, shell count in the magazine, squib status, temperature reports, operation status and any other system or component related information. As yet another example, a user may set a number of system attributes, including but not limited to selection of gunshot sound for each weapon emulator 10, whether the gunshot sounds will be broadcast and at what volume, and assigning squibs to each weapon emulator 10 and/or gunshot.

In some embodiments, the system 100 using a weapon emulator 10 may further comprise audio equipment 106 to provide sound feedback for the firing of the weapon emulator 10. Audio equipment 106 may include but is not limited to speakers, cables, and a Sound Controller 116. The sound equipment 106 is preferably located in a location where it will not show up in the field of view of any cameras but may still be easily heard by anyone using system 100.

In some embodiments, Sound Controller 116 may be part of the System Controller 108. In a preferred embodiment, when the user pulls the trigger of the weapon emulator 10, a wireless signal will be sent to the audio controller 116 and an audio response will be generated through the speakers 106. In the preferred embodiment, the audio response may be a gunshot sound.

The director or some other person may control the on-set sound of each gunshot. Different sounds may be used for different weapon emulators 10. Different volumes may be used for different weapon emulators 10. Some weapon emulators 10 within the system 100 may produce an audio response while other weapon emulators 10 in the same system 100 are set not to produce an audio response. When filming late at night, the volume may be turned down to accommodate any noise restrictions while still allowing feedback to the actors. As described above, all the sound settings may be configurable through the handheld controller 120.

In a preferred embodiment, the gunshot sounds played by the speakers 106 may be specially modified to enhance and help in the editing process. For example, rather than play a recording of an actual complete gunshot each time the weapon emulator 10 fires, a "clipped" version may be played. In a preferred embodiment, the leading and trailing edges of the clipped version are suppressed, thereby providing a sound that is still similar to a gunshot, but whose content is more certain to be successfully overwritten during editing by the longer duration "real" gunshot sound clip. In yet other embodiments, the gunshot sounds may be: 1.) single tone—a brief sinusoidal tone that is easy to filter out after-the-fact; 2.) multiple tone—a multi-tone burst that is simple to filter out, while providing a gun-aligned sound that is not as completely artificial as a single tone; 3.) Matched Spectral Construct—an actual high-fidelity audio clip of the gunshot from the sound library to be used, which is then overwritten (or simply amplitude boosted) during post-production sound editing; and 4.) Unique Spectral Construct—a digitally constructed audio waveform whose spectral content is explicitly defined, such that post-production digital signal processing could completely filter it out, while leaving any dialogue and other ambient sounds un-attenuated. In a preferred embodiment, this waveform would sound very gunshot-like, be relatively narrow-band, and be adjustable up or down the frequency scale in order to optimize its location on the sound spectrum to best "avoid" spectral overlap with other sounds expected to occur during filming.

Although the system 100 may be used for numerous different purposes, including military and police training, theater and many other purposes, the preferred use of a weapon emulator system 100 is for filming a movie. To this end, the system 100 may include one or more cameras 102. Although FIG. 3 illustrates a camera 102, a camera 102 is not a required component of the system 100. Cameras 102 may be thought of as part of the system 100 or simply as an element that interfaces with the system 100 when the weapon emulator system 100 is being used for film. As a non-limiting example, the same or similar system 100 may be used for theater with no camera 102. In a preferred embodiment, the cameras 102 interface with the Firearm Controller 112 through a shutter timing device 104. Examples of a shutter timing device include but are not limited to a genlock interface, jam sync interface or any other shutter timing device designed to provide frame-resolved alignment of asynchronous imaging equipment.

In a preferred embodiment, System Controller 108 includes a Firearm Controller 112. The Firearm Controller 112 is the primary link to all weapon emulators 10 in the system 100. The Firearm Controller 112 is the central interface for connection to the camera shutter timing device 104, the Sound Controller 116 (if present) and audio tracks, the Pyro Fx Controller 114 (if present), and any handheld controller 120.

The shutter timing device 104 may be used to guarantee the weapon emulator 10 is only used when the camera 102 shutter is open. In order to achieve this result, a genlock or jam sync connection 104 may be maintained between the Firearm Controller 112 and the cameras 102. In a preferred embodiment, the Firearm Controller 112 receives the timing information from the cameras 102 via the shutter timing device 104 and communicates that information to the weapon emulators 10. Use of the genlock or jam sync connection 104 is completely optional and if this connection does not exist, the system 100 and weapon emulators 10 may still be used without the guarantee of synchronization to the frame rate of the camera.

As mentioned above, the timing and time tag signal is preferably derived from the genlock output. The time tag signal is used to record a frame resolved data file which identifies the firing indicator 18 actuation of every weapon emulator 10 operating on the set. The data file may be used in post-production to allow after effects to easily be added to the film. For example, gunfire and muzzle flashes may be precisely auto-inserted during post production editing. In a preferred embodiment, the system 100 may include portable media 122 to allow for transferring the frame resolved data file for post-production and editing. In the embodiment shown in FIG. 3, a USB Flash Drive is used as the portable media, but in other embodiments, other forms of portable media may be used. Non-limiting examples of portable media include CD's, DVD's, Flash drives of various kinds, portable hard-drives and others.

In embodiments where pyrotechnics are used, the embodiment may also include a Pyro Fx Controller 114. The Pyro Fx Controller may be part of the System Controller 108. The Pyro Fx Controller 114 is the link between the operation of the weapon emulator 10 and all associated pyrotechnics. In a preferred embodiment, pyrotechnics include bullet or body hit squibs 124; however, in other embodiments, any type of pyrotechnic may be controlled or configured via the Pyro Fx Controller 114.

In a preferred embodiment, for safety purposes, the system 100 may have a human in-the-loop controller 118. The human in-the-loop controller 118 is any kind of interface that requires a human to physically activate. When dealing with pyrotechnics or any other type of explosive, the human in-the-loop may be able to arm and or disarm the explosives via the human in-the-loop controller 118. In a preferred embodiment, the human in-the-loop controller 118 interfaces with the Pyro Fx Controller 114 and arms and disarms the squibs 124.

In operation of a preferred embodiment, Firearm Controller 112 communicates with the optional Pyro Fx Controller, Sound Fx Controller and Wireless Interface 110 to provide synchronized use of both the weapon emulators 10, squibs 124 and audible gunshot sounds via the speakers 106. In a preferred embodiment, each operation of a weapon emulator 10 and/or squib 124 is time tagged and written to a data file for use in post-production.

Figure 4:
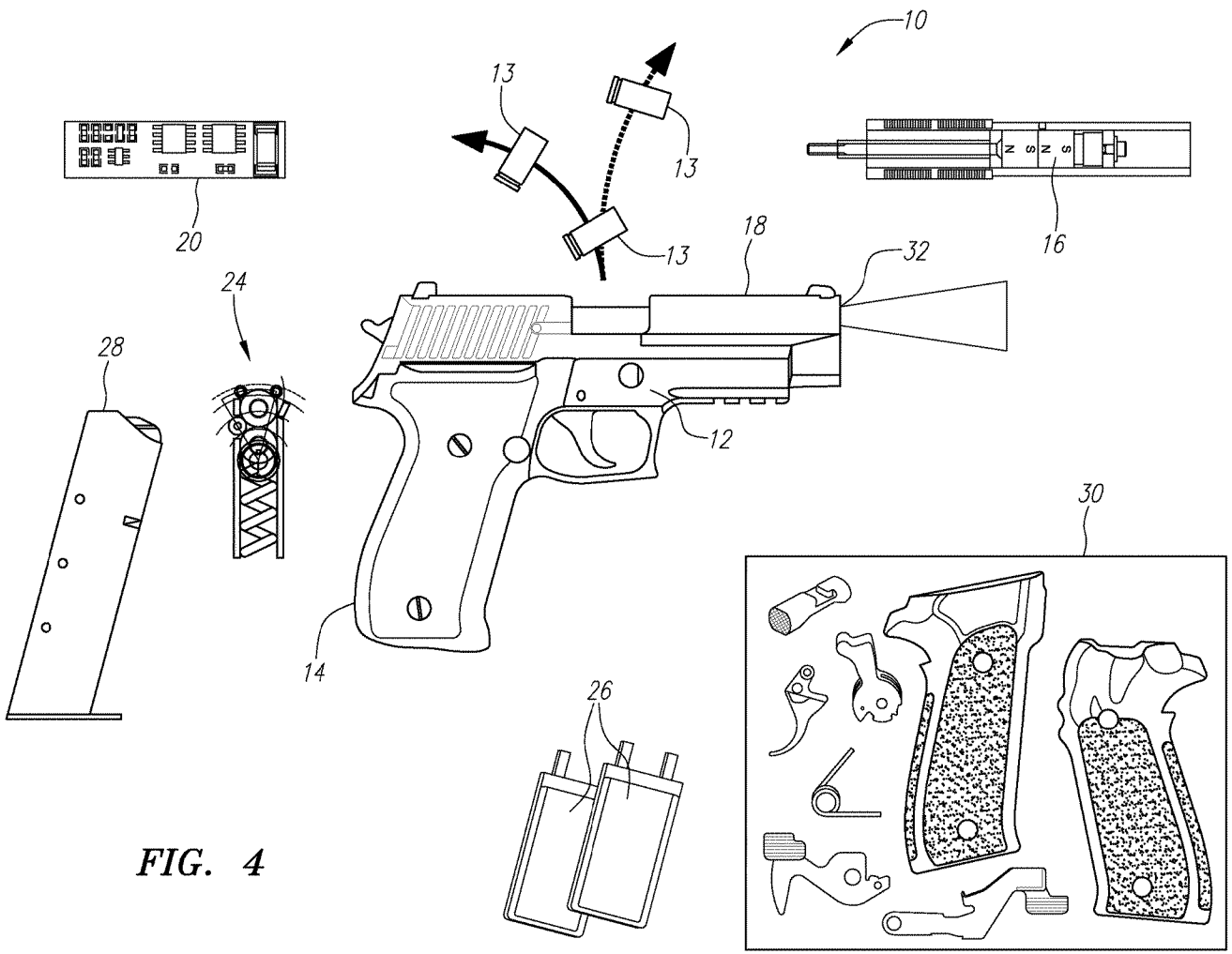
FIG. 4 illustrates an exploded view of one embodiment of a weapon emulator.

FIG. 4 illustrates an embodiment of a weapon emulator 10 with some of its components exploded out for easy viewing. In preferred embodiments, the weapon emulator 10 further comprises an electronics package 20, a shell ejection mechanism 24, a power supply 26, and a magazine 28.

The power supply 26 may be any type of power supply, including batteries, solar, direct line, or any other type of power supply. In a preferred embodiment, batteries are used. Batteries allow the weapon emulator 10 to be mobile. In various embodiments, various different kinds of batteries may be used, including but not limited to, wet cell batteries, dry cell batteries, galvanic cells, electrolytic cells, fuel cells, flow cells, and voltaic piles. In a preferred embodiment, Lithium Polymer (Li-Poly) batteries are used. Depending on the power requirements, in different embodiments, different numbers of batteries may be used. In a preferred embodiment, two Li-Poly batteries may be used.

The power supply 26 should be designed to provide power to work the electro-mechanical actuator 16 and supply the electronics package 20 with power. To this end, the power supply 26 may supply any voltage or amperage needed, depending on the particular embodiment's requirements. In a preferred embodiment, two Li-Poly batteries are connected in series to provide a nominal 7.4V for powering the motors directly. In a preferred embodiment, DC/DC converters convert the 7.4V into the correct voltage to supply the electronics package.

In the preferred embodiment, the two Li-Poly high capacity batteries comprise the power supply 26. Each battery is located under the handgrip on either side of the magazine well of the weapon emulator 10. In other embodiments, the power supply 26 may be stored in other locations and comprise other components. Preferably, the power supply 26 provides between 5 and 20 volts to the weapon emulator 10.

The embodiment of a weapon emulator 10 shown in FIG. 4 also comprises an electronics package 20. Electronics package 20 may also be referred to as control electronics 20. In a preferred embodiment, control electronics 20 are comprised of an embedded controller, full bridge motor drivers, power conversion, timing circuitry, and data communications such as wireless links. The electronics package 20 may be entirely located on a single board or may be separated into a number of boards. The electronics package 20 is preferably located either along the top of the barrel above the electro-mechanical actuator 16, or in the back of the butt of the handle of the weapon emulator 10. In some embodiments, components of the electronics package 20 may be located in both places. In other embodiments, the electronics package 20 may be located in other locations.

In a preferred embodiment, the weapon emulator 10 uses actual firearm components 30 wherever possible to make the weapon emulator 10 appear as realistic as possible. Although the body 12 will be custom made, typically CNC machined, many other components attached to the body 12 may be actual firearm parts 30 from a real weapon. In the preferred embodiment, the use of these parts in no way enables the use of the weapon emulator 10 as an actual weapon. Numerous types of parts may be available off-the-shelf for many different types of weapons. The use of real parts may also lower fabrication costs. Despite the advantages of using real weapon parts, the use of actual weapon parts is only for visual effect and is not a requirement of the embodiments disclosed herein.

The embodiment of a weapon emulator 10 shown in FIG. 4 also includes a magazine or clip 28. Embodiments may exist without a magazine or clip 28. In a preferred embodiment, the magazine 28 conforms to the correct external appearance of the real weapon. In a preferred embodiment, the magazine 28 may be an assembly and may contain the power supply 26, brass cartridges 13, shell ejection mechanism 24, and an electronics interface to the electronics 20 in the frame.

When a real weapon is fired, often a shell casing 13 is ejected. In order to visually mimic the firing of a real weapon, in some embodiments, the weapon emulator 10 may further comprise a shell ejection mechanism 24. In a preferred embodiment, the magazine 28 is fitted with a shell ejection mechanism 24 that allows empty shells 13 to be ejected from the weapon emulator 10 to simulate the same visual effect created when a real weapon ejects a shell. In other embodiments, no shell ejection mechanism 24 is present.

A shell ejection mechanism 24 is designed to visually simulate the ejection of a shell casing from the weapon emulator 10. The virtual shell casing 13 ejected from the shell ejection mechanism 24 may be anything that visually simulates the ejection of a shell casing. In some embodiments, real, spent or unloaded, brass shell casings may be used. In other embodiments, pieces of metal, plastic, rubber, or some combination thereof, may be ejected to simulate the visual appearance of a real shell casing being ejected. In a preferred embodiment, the shells 13 may include an embedded magnet installed in place of the primer, to aid in the electromechanical manipulation of the shell 13 during ejection.

In yet other preferred embodiments that include a shell ejection mechanism 24, the shell ejection mechanism 24 may occupy the space in the magazine 28 in front of the shell 13 where a bullet would typically be in a real gun. Because only spent or empty shells 13 are needed, room is left for the shell ejection mechanism 24 by the absence of the bullet. In a preferred embodiment, the ejection trajectory of the ejection mechanism 24 is adjustable.

In some embodiments, the weapon emulator 10 may further comprise a barrel tip locator 32. In a preferred embodiment, the barrel tip locator 32 may be a light such as a light emitting diode (LED), Laser or other type of light. The barrel tip locator 32 provides a visual indication of the origin of the barrel tip at the time the weapon emulator 10 is fired, to aid in placement of the digitized visual effect, such as a muzzle flash, during post-production film editing. The light source may be pulsed for a duration matched to the camera frame rate so that the flash of light appears on only one or two frames and coincides with the exact location and occurrence in time of the weapon emulator being fired. In yet other embodiments, other types of locators may be used. In some embodiments, the light emitted from the barrel tip locator 32 may be used to initiate and synchronize squib function.

Figure 5A:
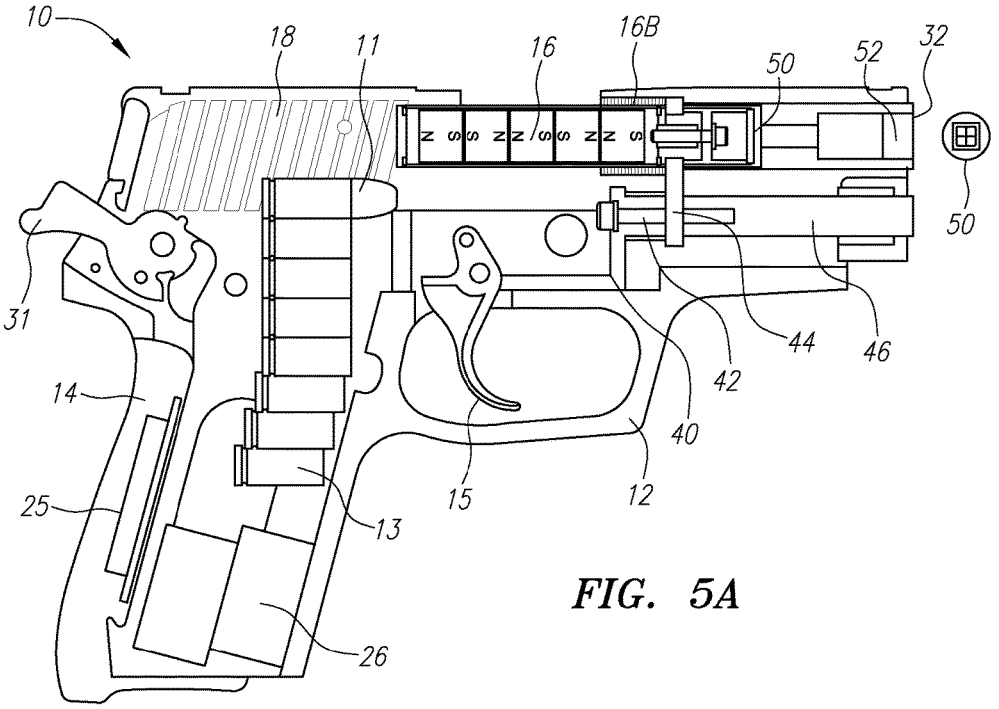
FIG. 5A illustrates a cross sectional view of one embodiment of a weapon emulator.

FIG. 5A illustrates a cross sectional view of one embodiment of a weapon emulator 10. The weapon emulator 10 in FIG. 5A includes a body 12, handle 14, power supply 26, firing indicator 18, electro-mechanical actuator 16, barrel tip locator 32 and electronics 20 and 25 (20 not shown in FIG. 5A). In FIG. 5A, the firing indicator 18 is a slide. The slide is shown in the forward position in FIG. 5A.

As may be seen, the weapon emulator 10 includes a trigger 15. The trigger 15 may be a standard trigger 15 from the actual weapon or one made to be visually similar. In either case, the trigger 15 has a non-standard mounting method. In operation, when the trigger 15 is pulled, the electro-mechanical actuator 16 is caused to activate; emulating the firing of the weapon. In some embodiments, the trigger 15 may be mechanically connected to the electro-mechanical actuator 16 such that pulling the trigger 15 mechanically activates the electro-mechanical actuator 16. However, in a preferred embodiment, a sensor is used and the pulling of the trigger 15 is sensed with the sensor. The activation of the electro-mechanical actuator 16 is handled via electronics and/or software based on the sensor output. In a preferred embodiment, the trigger sensor is a solid state sensor; however, in other embodiments, other sensor types may be used. In a preferred embodiment, the sensor senses the angular position of the trigger; however, other sensor types may be used including pressure sensors, accelerometers and others.

Below is described just one non-limiting example of a weapon emulator 10 including a solid state sensor for sensing the trigger 15 pull. In such an embodiment, the trigger 15 may incorporate a small magnet and an adjustable-threshold Hall Effect sensor will detect that the trigger 15 has been pressed far enough to be interpreted as a desire to fire the weapon emulator 10. In a preferred embodiment, the adjustable-threshold device will enable the sensitivity of the trigger 15 to be dialed in by software during production or changed in the field to accommodate some unique need. In some embodiments, the trigger sensitivity of each weapon emulator 10 may be set via the handheld controller 120.

Embodiments using a trigger sensor provide the added ability to better synchronize the audio output. By detecting the motion of the trigger 15, embedded software may determine that the operator wished to fire the weapon emulator 10, but delay the actuation of the electro-mechanical actuator 16 by the measured wireless link latency (determined previously in a one-time calibration step), thus causing the electro-mechanical actuator 16 to operate at the instant the Sound Fx Controller 116 finally delivers the gunshot sound to the on-set speakers 106. In a preferred embodiment, the fixed delay is a summation of all the latencies in the system 100, including sensor detection, wireless messaging from weapon emulator 10 to Sound Fx Controller 116, audio file selection, and streaming of audio to the speakers 106. All those combined delays should take no more than a few milliseconds, but if not accounted for, there may be a noticeable visual and auditory disconnect between the operation of the weapon emulator 10 and the expected gun sound.

In preferred embodiments, more advanced levels of automation and or control may be incorporated into the actual firing of weapon emulator 10. For example, regardless of a trigger pull, the weapon emulator may need to be momentarily or permanently armed by the Fire Arm Controller 112. If the Fire Arm Controller 112 only momentarily arms the weapon emulator 10, the system 100 can ensure the weapon emulator 10 is not inadvertently fired or fired at the wrong time.

In yet another embodiment, the weapon emulator 10 may provide a fire cue to the actor. For example, in a preferred embodiment, the Firearm Fx Controller 112 may send a signal to the weapon emulator 10 to pulse the internal electro-mechanical actuator 16. The pulsed actuator would cause the weapon emulator 10 to vibrate slightly and may be used as a cue to privately let the actor know they should take a pre-planned action. The Firearm Fx Controller 112 may control the signals such that the actor is cued at all the right times based on when the director wants the actor to fire the weapon simulator 10 or perform some other pre-planned action. The cue may be a single pulse (basic motion profile used to initiate a pre-planned response from the actor holding the weapon emulator 10), multi-pulse (series of two or more pulsed actuations), prolonged pulse (continuous stream of pulsed actuation commands for a programmable duration, such that the sensation felt by the user is similar to a vibration), timing pulse (fixed number of pulsed actuations, with the user informed beforehand that the actual cue will occur on the Nth pulse), pacing pulse (pulsed actuations issued periodically to provide a series of on-going cues to the user), or any other desired pattern of pulses. The commands to perform any of the above-listed actuation profiles are set up beforehand, and then initiated through a wired or wireless connection.

In a preferred embodiment, the simulated firing of the weapon emulator 10 may be synchronized to the camera 102 frame rate. For example, both the movement of the firing indicator 18 and the ejection of the shell 13 may be implemented under programmed computer control. Computer control enables the ability to ensure that the weapon emulator 10 is operated at the most optimum times relative to the frame capture rate of the movie camera, even allowing "micro-frame" programmability to operate the slide/bolt 18 and position the brass 13 to create the best effect within each captured frame image. In a preferred embodiment, this is accomplished by using the weapon emulator's trigger 15 as a "gate" which enables the firing of the weapon emulator 10 on the next full frame count of the camera 102, with additional programmable delays permitting the "micro-frame" adjustability feature. The electro-mechanical actuator 16 in the preferred embodiment may enable extremely fine control relative to the camera shutter.

In another aspect of the present patent document, a high-fidelity firearm effects library may be provided for use with a weapon emulator 10. A firearm effects library may include both audio cuts and film imagery that is precision matched for every model of weapon emulator 10 available, such that the post production sound and visual effects editors will be able to utilize the realistic sounds and sights that are uniquely characteristic of the specific firearm being used in a scene. Because the weapon emulator 10 is all controlled digitally and is in sync with the filming process, markers may be associated with the film frames in which the weapon emulator 10 is fired. The markers may be used in post-production to allow the quick and easy insertion of gun sounds and muzzle flashes.

In a preferred embodiment, the weapon emulator 10 may be set up to allow post production auto-insertion of gunshot effects. That is, software may be used to find these sound and visual markers and automatically insert sounds and sights associated with the weapon emulator 10. In an embodiment that allows auto-insertion of gunshot effects, all gun "action" may be recorded to a digital time-tagged data file with frame ID's so that the individual gunfire sound and visual effects, including dry cycling, may be automatically inserted into the precisely aligned places they belong in the audio and video/film tracks. In a preferred embodiment, the digital file may explicitly define the exact location in the sound track where the gunshot or other weapon sound should be heard, and also identify the type of weapon used, so the matching sounds may be selected from the sound library. The same principles may be applied to other sounds a firearm makes that are also recorded in real-time to the digital file, such as manually chambering a round, cocking or de-cocking the hammer, magazine insertion and extraction, and selector switch operation to name a few.

In order to associate external events to specific film frames, or locations on an audio track, a universal time-keeping method must be established. Although in some embodiments, a proprietary protocol could be developed, most professional recording equipment is already compatible with the SMPTE Time Code. In a preferred embodiment, SMPTE Time Code is used as the default time-keeping basis.

In a preferred embodiment, every action associated with the operation of a weapon emulator 10 is accounted for by identifying the weapon emulator 10, the action, and the SMPTE Time Code when the action occurred, and recording this information to a digital file. In a preferred embodiment, the digital file is maintained by the controller embedded in the weapon emulator 10 itself. This file is then transferred wirelessly to an external memory device (i.e. a thumb drive) for use in the post-production editing process. In other embodiments, the file may be maintained by the Firearm Fx Controller 112.

In embodiments where more than one weapon emulator 10 is being used, all individual timelines may be merged in order to present the post-production editors with all weapon emulator 10 events in one convenient file. Alternatively, the individual timeline files may be left separate, and be utilized serially in the editing process.

In some embodiments, the embedded controller in the weapon emulator 10 or Firearm Fx Controller 112 has the capability to interface with compatible time code sync devices to perform a "jam sync," thereby aligning all compatible recording devices with the master frame clock source. In embodiments with multiple recording devices in use, like on a typical movie set, it is generally necessary to ensure that all are operating in alignment with the same running time code. This may be accomplished by performing a "jam sync" on all the compatible recording devices to align them with the master frame clock source. A common device that is used for this purpose is the Denecke SB-T Time Code & Video Sync Generator, and the embedded controller in the weapon emulator 10 may include the ability to interface with this and compatible time code sync devices.

As an aid in accelerating the post-production editing process, the Timeline Data Log may also support the automated insertion of gunfire sounds, since the time tagged data file explicitly defines the exact location in the sound track where the gunshot should be heard, and also identifies the type of weapon emulator 10 used. Accordingly, the matching gunshot may be selected from the sound library. This same principle applies to other sounds a weapon emulator 10 makes, which are also recorded in real-time to the data file, such as manually chambering a round, cocking or de-cocking of the hammer, magazine insertion and extraction, selector switch operation, etc.

Returning to FIG. 5A, a number of brackets, standoffs and fasteners 40, 42 and 44 may be used inside the body 12 of the weapon emulator 10 to secure the various components. The size, shape and placements of these brackets, standoffs and fasteners 40, 42 and 44 may vary from embodiment to embodiment and will likely vary depending on the particular size and shape of the weapon emulator 10.

In the embodiment shown in FIG. 5A, the bracket 40 is a mount for the electro-magnetic actuator 16. The bracket 40 secures in place the magnet stack for the electro-magnetic actuator, and also acts as the reference surface/feature for ensuring proper alignment of the electro-magnetic motor and attached components to the body 12 and slide 18 of the weapon emulator 10. In the embodiment shown in FIG. 5A, standoffs 42 and 44 are aluminum standoffs which secure the magnet stack to the electro-magnetic actuator 16 mount.

The particular type of weapon which is emulated in FIG. 5A, The Sig Sauer P228 includes a Return Spring Guide Rod 46. The Return Spring Guide Rod 46 is found in most semi-automatic handguns. In a preferred embodiment, it is included in the weapon emulator 10 to maintain realism, since it is exposed during firing when the slide 18 recoils back. In some embodiments, a solid state sensor may be embedded inside the Return Spring Guide Rod 46 to sense the position of the slide 18 during cycling/operation.

Figure 5B:
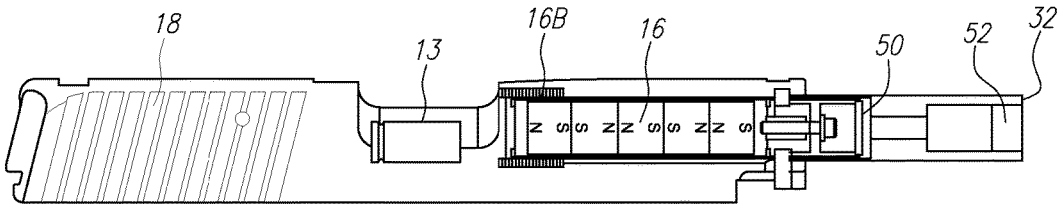
FIG. 5B illustrates a cross section view of the top portion of the weapon emulator in FIG. 5A with the slide retracted.

FIG. 5B illustrates a cross section view of the top portion of the weapon emulator in FIG. 5A with the slide retracted.

In the embodiment shown in FIG. 5A, the slide 18 has a stroke of about 1.75 inches. To this end, the slide 18, retracts over the body 12 of the weapon emulator 10 about 1.75 inches when the weapon emulator 10 simulates a round being fired. In other embodiments, other amounts of relative movement between the firing indicator 18 and the body 12 may be used.

When the slide is in the retracted position as shown in FIG. 5B, a hole in the slide allows for a shell 13 to be ejected. If the weapon emulator 10 is equipped with a shell ejection mechanism 24, (not shown) then a shell 13 will be ejected from the weapon emulator 10. In a preferred embodiment, a brass shell including a bullet may be fixed in the topmost location in the magazine 28 such that when the slide 18 is retracted, it appears another round of ammunition is ready to be chambered.

As is shown in both FIGS. 5A and 5B, the barrel tip indicator 32 may be comprised of a number of components. In the embodiment shown, the barrel tip indicator 32 includes a small electronics board 50 with an LED attached. At the correct time, the electronics board 50 supplies power to the LED which causes the LED to illuminate. The LED may shine through a lens/filter 52 located at the end of the barrel. The lens/filter 52 may be a lens, filter or combination of the two. The lens/filter may focus the light from the LED, disperse the light from the LED or simply let it pass. If a filter is provided, the filter may be polarizing or non-polarizing and may affect the color and or reflectivity of the light emitted from the barrel.

Figure 5C:
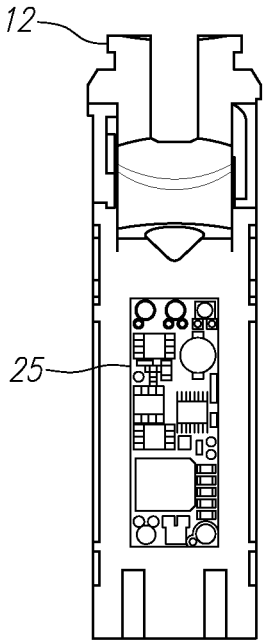
FIG. 5C illustrates a rear view of the weapon emulator of FIG. 5A with a portion of the handle removed such that the electronics are visible.
Figure 5D:
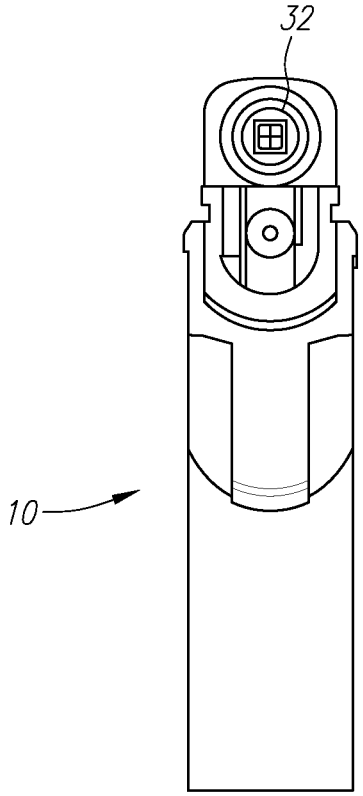
FIG. 5D illustrates a front view of the weapon emulator of FIG. 5A with the slide removed and the barrel tip indicator exposed.

FIG. 5C illustrates a rear view of the weapon emulator of FIG. 5A with a portion of the handle removed such that the electronics are visible. FIG. 5D illustrates a front view of the weapon emulator 10 of FIG. 5A.

Figure 6A:
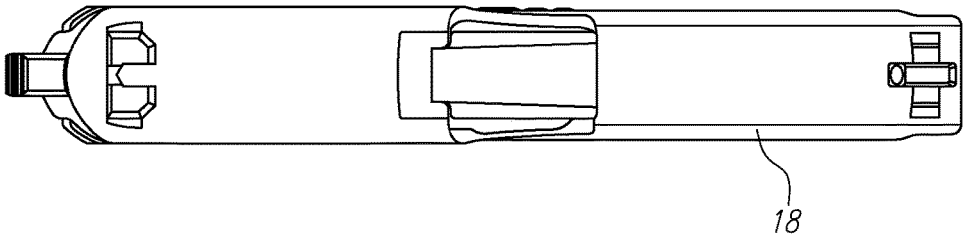
FIG. 6A illustrates a top view of the weapon emulator of FIG. 5A.
Figure 6B:
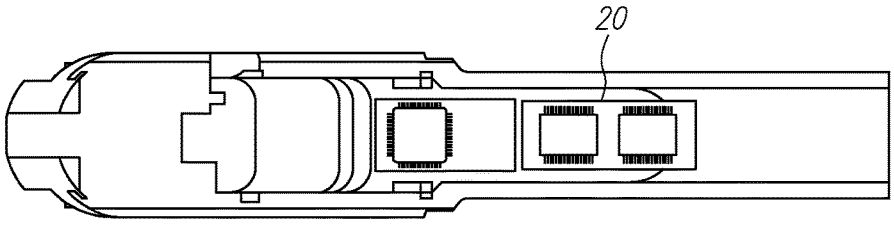
FIG. 6B illustrates a top view of the weapon emulator of FIG. 6A with the firing indicator removed.

FIG. 6A illustrates a top view of the weapon emulator of FIG. 5A. The firing indicator 18 is shown in the forward position. FIG. 6B illustrates a top view of the weapon emulator of FIG. 5A with the firing indicator 18 removed. As may be seen in FIG. 6B, the electronics package 20 may be positioned above the electro-mechanical actuator 16 and below the firing indicator 18 inside the weapon emulator 10.

Figure 7A:
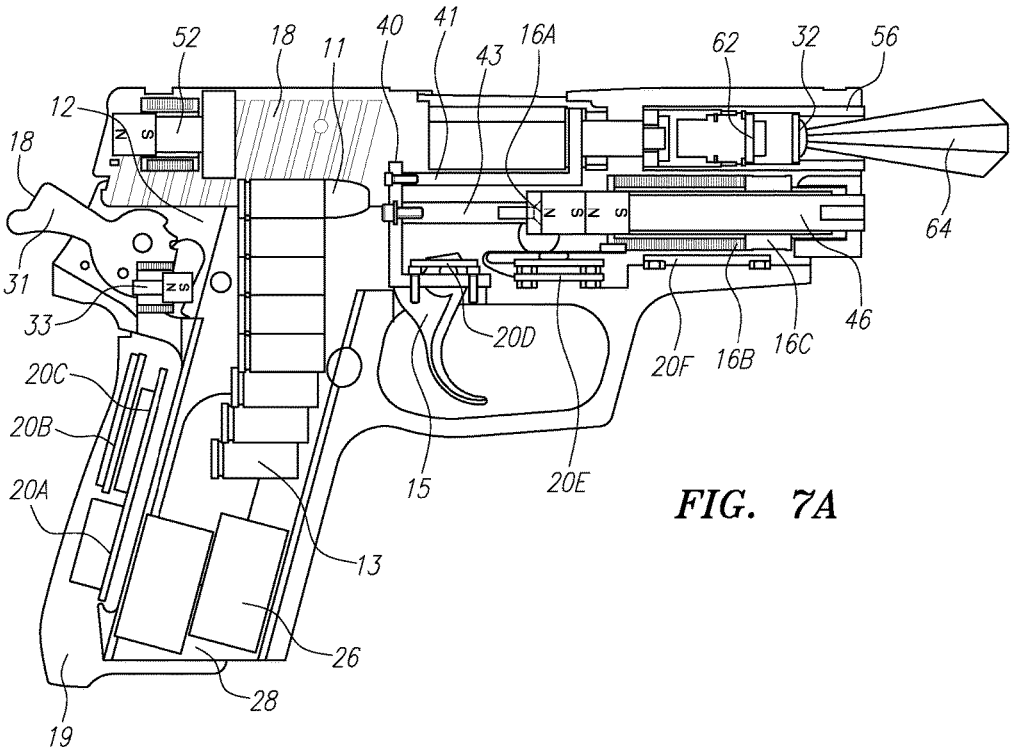
FIG. 7A illustrates a cross sectional view of another embodiment of a weapon emulator.

FIG. 7A illustrates a cross sectional view of another embodiment of a weapon emulator 10. The weapon emulator 10 shown in FIG. 7A is similar to the weapon emulator shown in FIG. 4A. However, the weapon emulator shown in FIG. 7A has the electro-mechanical actuator 16 in a different position, below the barrel assembly. Placing the electro-mechanical actuator 16 below the barrel makes construction simpler, as well as having a positive effect on "negative" recoil. The embodiment shown in FIG. 7A also has additional features discussed below.

The embodiment in FIG. 7A shows the electro-mechanical actuator 16 comprising a magnetic stack 16A, motor coil spool 16C and motor coils 16B. In other embodiments, other types or designs of electro-mechanical actuators 16 may be used. In the embodiment shown in FIG. 7A, the motor coils 16B are wound onto the motor coil spool 16C. The embodiment shown in FIG. 7A uses a multi-solenoid 2-coil configuration. In other embodiments, a single solenoid or coil may be used or more than one solenoid or coil may be used. The magnetic stack 16A uses 3 magnets with opposite poles attached. In other embodiments, other numbers of magnets may be used. The length of the magnetic stack 16A and motor coils 16B may be designed such that the appropriate stroke of the firing indicator 18 is achieved when the electro-mechanical actuator 16 is activated.

As may be seen, the electro-mechanical actuator 16 in the embodiment shown in FIG. 7A is located below the barrel. The magnetic stack 16A is secured in place via magnet mount 43 coupled to the motor mount 40. The electro-mechanical actuator 16 is driven by the part of the electronics package 20. In the embodiment shown in FIG. 7A, a motor coil driver assembly 20E is provided. In a preferred embodiment, the motor coil driver assembly 20E is a dedicated H-bridge driver with support circuitry on a printed circuit board which sinks & sources high current through each motor coil 16B.

In a preferred embodiment, the position of the electro-mechanical actuator 16 may also be sensed by the electronics 20 for feedback purposes. In the embodiment shown in FIG. 7A, a position sensor assembly 20F is used to provide position feedback to the embedded controller in support of the electro-mechanical actuator 16 drive functions.

The embodiment shown in FIG. 7A includes a grip 19. The grip 19 is preferably the actual grip designed to be used with the real weapon. However, it may be a grip 19 manufactured to look like the real grip. In either case, the grip preferably allows the installation of components for the weapon emulator 10 as shown in FIG. 7A.

In the embodiment shown in FIG. 7A, a number of electronic components 20A, 20B and 20C are located under the grip. Electronic component 20A is a Power converter. Power converter 20A interfaces to the batteries and provides all the voltages needed by the weapon emulator 10, and insures that these voltages remain constant as the batteries are discharged. Component 20B is wireless communication electronics. The wireless communication electronics 20B provide wireless communications capabilities for the weapon emulator 10. In a preferred embodiment, the wireless communication electronics 20B provide communication with the handheld controller 120 via a Bluetooth connection. Component 20C is an embedded controller. The embedded controller 20C is the "brains" of all system capabilities in the weapon emulator 10. By upgrading the firmware in the embedded controller, new capabilities may be added and existing capabilities may be modified.

The embodiment shown in FIG. 7A includes a second firing indicator 18 in the form of a hammer 31. In a preferred embodiment, the hammer 31 may be the actual part from the real firearm. In other embodiments, the hammer 31 may be manufactured to visually resemble a real hammer. In a preferred embodiment, the hammer is modified to actuate under independent control such that it may also function as a firing indicator 18. To this end, a hammer motion assembly 33 is provided. The hammer motion assembly 33 may be any electro-mechanical actuator 16. In the embodiment shown in FIG. 7A, a single solenoid and coil are used. However, in other embodiments, any type of electro-mechanical actuator 16 may be used. The hammer motion assembly 33 provides automated actuation of the hammer 31 in sync with the slide 18 motion. In a preferred embodiment, the hammer motion assembly 33 also supports manual cocking by the user.

In a preferred embodiment, the weapon emulator 10 includes a recoil effect assembly 52. Recoil effect assembly 52 provides a recoil effect. The recoil effect assembly 52 in FIG. 7A is anchored to the body 12 and pushes against a semi-floating reaction mass. In a preferred embodiment, the recoil effect assembly 52 is located as high as possible within the rear section of the slide, thereby maximizing the rotational effect of the body 12 experienced by the hand that occurs upon actuation of the recoil feature.

In a preferred embodiment, a recoil reaction actuator 52 comprises a reaction mass, which provides a substantial mass against which the weapon emulator 10 body 12 can electro-mechanically push. The reaction mass is actuated coincident with the firing of the weapon emulator 10, imparting both visible and physically felt recoil to the user holding the weapon emulator 10. The recoil phase of the slide/bolt motion is accompanied by an immediate full-force "push" of the actuator against the reaction mass, thus imparting the desired "hard" recoil effect. The return phase of the slide/bolt motion is accompanied by a broadly applied low-force "pull" of the actuator toward the reaction mass, enabling the mechanism to return to its ready position and await the next triggering of a recoil event. In a preferred embodiment, a moving coil actuator is used to cause the body 12 to recoil backwards in a manner similar to the firing of a real gun. The moving coil actuator further augments the reaction mass with the weight of the rotor magnet. In the embodiment shown, the rotor (magnet) connects to the reaction mass and the stator (coil) connects to the body 12.

In operation, the firearm controls on weapon emulator 10 are generally used as they would be used on a real firearm (i.e. the trigger is pulled to fire the gun, etc.), with some additional system management capabilities. In a preferred embodiment, the programmable controller 20C enables the implementation of an end-to-end Built-in-Self-Test (BIST), as well as full battery 26 assessment and management, in order to ensure that the weapon emulator 10 is fully functional and ready to perform without error while filming. In a preferred embodiment, the weapon emulator 10 controls may also include any of the following capabilities: 1.) The magazine catch may include an added sensor that detects use to alert the embedded controller 20C that battery power is about to be removed, initiating sleep mode or an orderly shutdown of the weapon emulator 10; 2.) The trigger 15 may be instrumented with a sensor as an input switch for data entry and feature selection during manual setup; 3.) The hammer 31 may be a combined actuator and sensor to enable cocking manually as well as from the slide 18 motion; 4.) The decocking lever may include a sensor, which when activated prompts the controller 20C to actuate the hammer 15 to maintain realistic usage; 5.) The slide 15 catch lever may include a sensor, which when activated prompts the controller 20C to release the slide 18 forward as if under the force of a return spring; 6.) The take-down lever may not be used as normal for disassembly, instead a multi-angle sensor is installed so the lever may be used for mode selection, with the trigger acting as an input. In other embodiments, other capabilities may be added.

In some embodiments, the time and location of visual effects may be designated by a barrel tip locator 32. In the embodiment shown in FIG. 7A, the barrel tip locator 32 is an RGBW four emitter LED. In a preferred embodiment, the barrel tip locator 32 is capable of scene matching, such that both the color and intensity of the flash of light are adjustable to maximize effectiveness relative to the scene being filmed.

In a preferred embodiment, the barrel tip locator 32 is capable of single-frame designation (light source is pulsed "on" for a duration correlated to the camera frame rate so that the flash of light only appears on the one frame that coincides with the actual moment that the muzzle flash should occur) and multi-frame designation (same as single-frame designation but for multiple frames). In embodiments where the light source is an LED, the LED may be a single LED or a multiple LED light source. A single LED supplies a monochromatic light source in a wavelength that is broadly suitable for most filming conditions. Multi-LED light sources are constructed of a plurality of wavelengths and provide for a programmable variety of colors to optimize their suitability for the filming conditions at that moment. For example, a multiple LED light source could be an RGBW four-color LED array as shown in FIG. 7A. The LED 32 may be controlled by embedded electronics such as an LED driver 62, with the emitted color selected so as to minimize reflections in the scene being filmed. A multi-spectral source like this also provides the possibility of doing unconventional color mixing in order to achieve unusual or unique colors, if so desired by the film maker. In other embodiments, the light source may be a laser, or is monochromatic, RGBW, or polarized light to name a few.

In preferred embodiments, the weapon emulator 10 includes hardware or software support to enable tuning the light source to a specific wavelength, or combination of wavelengths, whose combination has the least contrast with the scene being filmed. In one embodiment, the weapon emulator 10 includes hardware or software support to enable scaling the brightness of the tuned light to the lowest level needed while still designating the location of the barrel tip for the purpose of digitized muzzle flash insertion.

In some embodiments, the weapon emulator 10 contains a device capable of reflection minimization. In a preferred embodiment, the device is a rotatable optical polarizer element for alternative reflection control. By only allowing the projection of polarized light, and providing for its angle adjustment, further control is maintained over the intensity of reflection artifacts, as recorded by the camera. In other embodiments, the device may be some other device capable of minimizing reflections on surrounding objects.

In one embodiment, the light source/barrel assembly will be treated as a Line Replacement Unit (LRU), so that different light sources can be interchanged to accommodate different filming conditions. This enables the dictates of the film maker to be implemented without undue delay.

In some embodiments, the end of the barrel may include visibility enhancers. In an even more preferred embodiment, the visibility enhancers are frosted (or other dispersive finish) light-transmissive plugs. This increases light source observability when the camera is positioned behind the firearm.

In operation the visibility enhancers may work as follows: when the weapon emulator is fired, particularly in the case of a pistol, the slide moves back during the recoil phase of operation, exposing the plug, which is immediately illuminated by the light source. This provides the intended muzzle flash designation point, which is now visible from any angle, rather than just from the front. In an even more preferred embodiment, the light transmissive plug is briefly actuated forward at the moment of firing, illuminated, and then retracted. This provides the insertion point for the digitized muzzle flash, which overwrites the presence of the plug in the image. If the plug extends far enough, the captured image could be processed to determine the 3D pointing vector needed to perform auto-insertion of a muzzle flash with the proper 3D orientation. In another embodiment, a set of plugs may be supplied, each with selectively applied surface opacity, for a variety of scene options to prevent reflections and other unwanted artifacts from being captured during filming.

As explained above, in some embodiments of a system 100 using a weapon emulator 10, the weapon emulator 10 may be wirelessly synced up to body-hit squibs 124 through the electronics control system. In a preferred embodiment, each squib may be tied to a specific round in the weapon emulator 10. Accordingly, when the weapon emulator 10 is fired, the timing and explosion of the body-hit squib 124 may be coordinated and synced with the firing. In a preferred embodiment, the wireless link may be encrypted and the System Controller equipped with a deadman switch 118 under direct control of the stunt coordinator to prevent accidental firing of any squibs 124.

In another embodiment, the barrel indicator 32 light source may be used to initiate or synchronized the squibs 124. In such an embodiment, the light source is used to sweep across squib targets and either automatically fire and initiate the squibs, or to cause the weapon emulator 10 to pulse, giving the actor an indication to pull the trigger. Embodiments using the light source of the barrel indicator 32 to initiate or synchronize the activation of the squibs 124 may create added realism that the weapon emulator 10 is pointed at the target when the squib 124 is initiated. The relatively narrow cone of light emission from the light source in the barrel is an alternative to wireless control and ensures an improved visual correlation between the weapon emulator 10 aim point and the activated squibs 124.

Figure 7B:
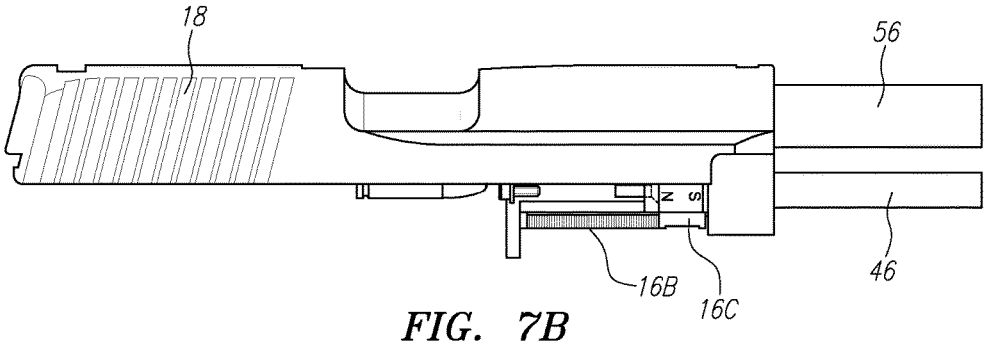
FIG. 7B illustrates a side view of the top portion of the weapon emulator of FIG. 7A with the firing indicator in the retracted position.

FIG. 7B illustrates a side view of the top portion of the weapon emulator 10 of FIG. 7A with the firing indicator 18 in the retracted position. When the firing indicator 18 is in the retracted position, both the Return Guide Rod 46 and the Barrel Assembly 56 are exposed. In a preferred embodiment, both the Return Guide Rod 46 and the outside of the Barrel Assembly 56 maintain their visual appearance as close as possible to the real firearm.

Figure 8B:
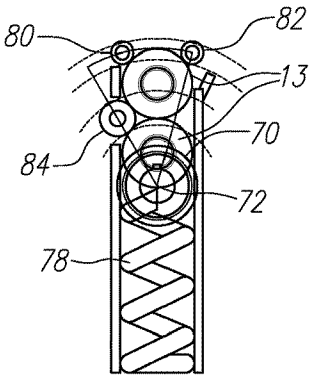
FIG. 8B illustrates a rear view of one embodiment of a shell ejection mechanism.
Figure 8A:
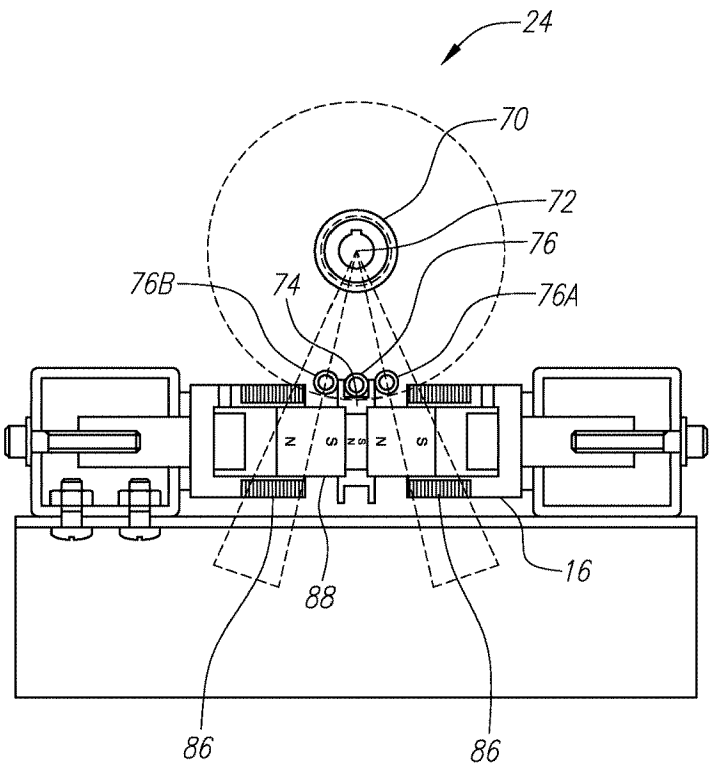
FIG. 8A illustrates a front view of one embodiment of a shell ejection mechanism.
Figure 8C:
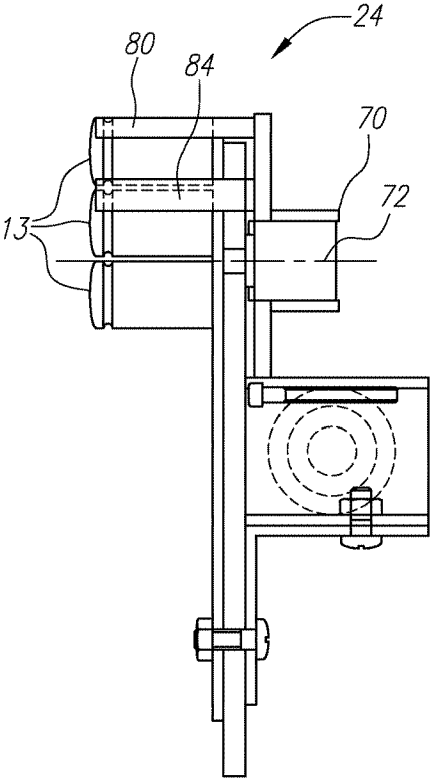
FIG. 8C illustrates a side view of one embodiment of a shell ejection mechanism.

FIG. 8A illustrates a front view of one embodiment of a shell ejection mechanism 24. In the embodiment shown in FIG. 8A, the test setup is shown for such an embodiment. However, FIGS. 8B and 8C illustrate the rear view and side view of the shell ejection mechanism 24 adapted for use in a weapon emulator 10. If a magazine is loaded with spent shells or their equivalent rather than "normal" ammo with bullets installed, the entire length of the front of the magazine remains open. Accordingly, in preferred embodiments, shell ejection mechanism 24 is designed to fit in the space a typical stack of ammunition would occupy in a magazine 28. This allows the shell ejection mechanism 24 to be placed in the magazine 28 and eject the empty shells 13 from the magazine 28 of the weapon emulator 10. It also allows the magazine 28 to be ejected, removed and/or handled while still maintaining the appearance of a normal magazine.

As may be seen in FIG. 8A, one embodiment of a shell ejection mechanism 24 includes a pivot point 72. Pivot point 72 may be provided by a bearing 70 or some other type of device that provides rotation. In some embodiments, a precision bearing like those used in hard drives may be used.

The embodiment shown in FIG. 8A further comprises an electro-mechanical actuator 16, pivot coupler 74, pivot handle 76, shell ejector 84, shell stop 80 and shell stop 82. (Shell ejector 84, shell stop 80 and shell stop 80 are shown in FIGS. 8B and 8C). One or more of pivot handle 76, shell ejector 84 and shell stops 80 and 82 may be embodied by a roller. Using a roller reduces friction and jamming because the roller releases any force build up. In a preferred embodiment, at least shell ejector 84, and shell stops 80 and 82 are rollers.

FIG. 8B is a rear view of the "rest" position of one embodiment of a shell ejection mechanism. In the "rest" position, the shell ejector 84 and shell stop 82 (the two pivoting rollers on the upper/right and lower/left) are on either side of the middle line that goes through the pivot point 72, so the top-most shell 13 pressures the upper/right roller to the right, while the second shell (or shell-shaped magazine follower if the upper shell is the last one) pressures the lower/left roller to the left, creating a rigid stasis that self-balances the top-most shell 13 at the "rest" position.

In operation of a preferred embodiment, shell stop 80 is fixed while shell stop 82, shell ejector 84 and pivot handle 76 are pivotally connected about pivot point 72. In a preferred embodiment, electro-mechanical actuator 16 is coupled to the pivot handle 76 via pivot coupler 74. In the embodiment shown in FIG. 8A, the electro-mechanical actuator 16 is designed to move pivot coupler 74 in a linear motion back and forth. The linear motion of pivot coupler 74 causes the pivot handle 76 to rotate about the pivot point 72 and move through positions 76A and 76B as the pivot handle 76 swings through an arc about the pivot point 72.

In the preferred embodiment, shell ejector 84 and shell stop 82 pivot about pivot point 72 and are in fixed relation to pivot handle 72. Pivot stop 80 remains fixed in a preferred embodiment. Accordingly, when the electromechanical actuator 16 moves the pivot handle 76, shell ejector 84 moves in a corresponding arc up and under top-most shell 13 and pivot stop 82 moves in a corresponding arc out of the way of the rising top-most shell 13. As the motion continues, shell ejector 84 eventually extends far enough into the magazine 28 to eject the top-most shell 13 and pivot stop 82 has moved far enough out of the way to allow the top-most shell 13 to be ejected. As the motion of the electro-mechanical actuator 16 and consequently the pivot handle 76 reverses, shell ejector 84 recedes from the interior of the magazine 28 and shell stop 82 returns to its interfering position while spring 78 forces a new shell into the ready position.

Figure 9:
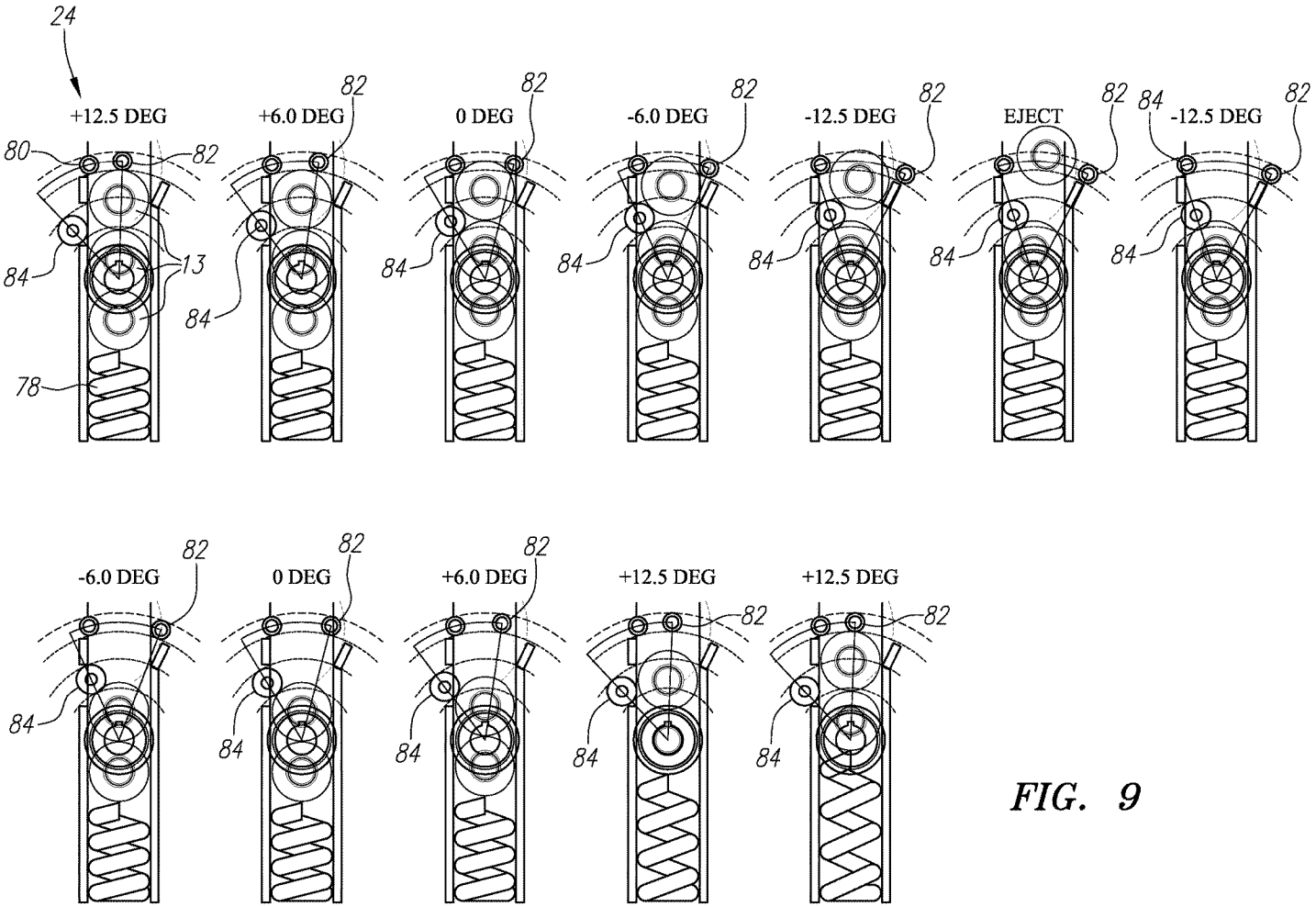
FIG. 9 illustrates one embodiment of a shell ejection sequence for the shell ejection mechanisms shown in FIGS. 8A-8C.

FIG. 9 illustrates one embodiment of a shell ejection sequence for the shell ejection mechanisms 24 shown in FIGS. 8A-8C. In a preferred embodiment, the resting position of the shell ejection mechanism is shown as the illustration labelled "0 degrees." The "rest" position is where the shell ejection mechanism 24 waits for the next trigger pull. Once the shell ejection mechanism 24 senses a trigger pull, a quick pulse of the electro-mechanical actuator occurs. In a preferred embodiment, a small actuator solenoid, snaps the shell ejection mechanism 24 to the −12.5 degrees position, ejecting the shell. Snapping the solenoid back to +12.5 degrees allows the next shell to be loaded, and with the solenoid de-energized, the shell is pushed up to the "rest" position by the spring for the next trigger pull.

The embodiment and process shown in FIG. 9 will now be described in more detail. As the illustrations in FIG. 9 progress from left to right, the electro-mechanical actuator 16 (not shown) moves the pivot handle 76 (not shown) through an arc about pivot point 72. When the pivot handle 76 is caused to move through an arc about pivot point 72, shell ejector 84 and shell stop 82 are caused to move through their respective arcs because they are in fixed relation to pivot handle 76, with respect to pivot point 72. Accordingly, at 0 degrees, the shell ejector 84 is positioned half inside and half outside the magazine 28 and the shell stop 82 is above to the right of the top-most shell 13. The distance between shell stop 80 and shell stop 82 is small enough to prevent shell 13 from coming out of the magazine 28. As the illustrations progress to the right through −6 degrees and all the way to −12.5 degrees, shell ejector 84 proceeds into the magazine 28 in an arc that brings it up and under the top-most shell 13 causing the top-most shell 13 to be forced up. At the same time, shell stop 82 proceeds in an arc from above the top-most shell 13, blocking its escape, to off to the side of the magazine allowing the top-most shell 13 to be ejected in the illustration labelled "EJECT." In the illustration labelled "EJECT" the shell ejector 84 and the shell stop 82 are still in the same position as shown in the −12.5 degrees illustration, however the shell has just progressed out of the magazine due to the force of impact from the shell ejector 84.

The shell ejector 84 plays two roles. As shell ejector 84 moves into magazine 28 it not only forces the top-most shell 13 to be ejected, but it provides an obstacle to prevent any other shells 13 from exiting the magazine 28 while the shell stop 82 is off to the side. Without shell ejector 84 becoming an obstruction, spring 78 may force all the shells 13 out of the magazine 28 in the eject configuration.

Once the top-most shell 13 is ejected, the electro-mechanical actuator 16 reverses direction and swings pivot handle 75 in the opposite direction causing shell ejector 84 and shell stop 82 to swing back in the opposite direction; returning to their starting positions. However, in a preferred embodiment, the pivot handle 76 proceeds past the original starting point to continue to move shell ejector 84 completely out of the magazine 84 to allow another shell 13 to be easily moved up into a position to be ejected. This is illustrated at +12.5 degrees.

Finally, in a preferred embodiment, the electro-mechanical actuator 16 reverses one more time and the shell ejector 84 and shell stop 82 are returned to their starting positions at 0 degrees.

In a preferred embodiment, a supply of shell stops 82 with a variety of angled profiles may be supplied. The different angled profiles of the shell stops 82 may be used so that the ejection trajectory of the shell 13 may be tailored. In a preferred embodiment, the various shell stops 82 may be retrofit to the shell ejection mechanism 24 to provide custom ejection trajectories of the shells 13.

In the preferred embodiment, the shell ejection mechanism 24 is powered by an electro-mechanical actuator 16. The electro-mechanical actuator 16 allows control over how and when the shell 13 is ejected from the weapon emulator 10. In some embodiments, the electro-mechanical actuator 16 may include a number of magnets. In some embodiments, the pivot coupler 74 may be held in place by the magnetic attraction between the magnets of the electro-mechanical actuator. In a preferred embodiment shown in FIG. 8A, the coils are wired in reverse from each other and located at the opposite ends of the combined magnet, acting on the magnetic fields that exist there.

In one embodiment of the electro-mechanical actuator 16 for the shell ejection device 24, two coils are used, each of which acts simultaneously on either end of a single magnet, thereby providing twice the push force. The coils may be driven by a single channel, and therefore are wired in series, but with one coil in reverse (so the current flows in the opposite direction), since one coil acts on the N-pole end while the other coil acts on the S-pole end. In this manner, current from the bridge driver snaps the actuator assembly in one direction to eject a shell, and then the bridge is reversed to snap the actuator in the other direction to load the next shell.

In yet another embodiment, the coils may be wired in parallel instead of series, thereby doubling the current through each coil (As a non-limiting example, 7.4V @ 2.2 A in series, 7.4V @ 8.8 A total in parallel). Doubling the current effectively doubles the force the actuator applies to the shell.

In a typical embodiment, the actuator times for loading and ejecting may be around 30 ms and 50 ms respectively. In yet another embodiment the actuator times may be around 15 ms and 25 ms respectively. However, other times may be used. In a preferred embodiment, smaller times may be used resulting in less battery use.

In a preferred embodiment, which may result in the most realistic shell ejection, the times for ejection may be reduced to 10 ms and 5 ms for loading and ejecting respectively. When the load and ejection times are reduced to properly timed values, the shell ejector functions as described above. However, with the reduced actuation times, the shell is still being ejected when the actuator snaps back the other way and causes the shell stop 82 to strike the shell 13 before it has fully exited the magazine 28. This may cause additional realism to the trajectory of the shell ejection.

In a preferred embodiment, the primer cap of the shell is replaced with a magnet of the same size and finish to aid in electromagnetically positioning the shell prior to ejection. In a preferred embodiment, the shell ejection mechanism can eject shells at different angles, in different directions, for different distances, or with different velocities. In other embodiments, other mechanisms may be used to eject shells, including purely mechanical means like springs etc. In other embodiments, the shells can be selectively programmed to intentionally jam, instead of ejecting, during firing. This may be a software only function that does not require any specific alteration of the shell itself.

In some embodiments, in order to distinguish a weapon emulator 10 from a real gun, both of which may coexist on a movie set, the weapon emulator 10 may operate the barrel tip indicator 32 with various blinking patterns and color combinations in order to distinguish itself as a "safe" non-firing prop gun. This feature may be wirelessly activated by an authorized crew member, such that the blinking occurs only during those periods when filming is not taking place. During filming, the weapon emulator 10 will operate as intended, with the barrel tip indicator 32 flashing once for every round fired, then returning to its "safe" blink function once filming has stopped. Different colors or rates of blinking may be used to indicate different information such as the current state of filming.

In yet other embodiments, the slide of each weapon emulator 10 may be automatically retracted under wireless control of the stunt coordinator (or other designated crew member), as an additional indicator that the weapon emulator 10 is in a "safe" condition.

Although the embodiments have been described with reference to preferred configurations and specific examples, it will readily be appreciated by those skilled in the art that many modifications and adaptations of the electronic device with a customizable image and methods therefore described herein are possible without departure from the spirit and scope of the embodiments as claimed hereinafter. Thus, it is to be clearly understood that this description is made only by way of example and not as a limitation on the scope of the embodiments as claimed below.

What is claimed is:

1. A weapon emulator system comprising:

a shutter timing device configured to receive shutter timing information from at least one camera;

a weapon emulator comprising:

a body;

an electro-mechanical actuator coupled to the body;

a firing indicator coupled to the electro-mechanical actuator; and electronics in data communication with the shutter timing device and designed to receive the shutter timing information and synchronize the activation of the electro-mechanical actuator with a camera shutter using the shutter timing information.

2. The weapon emulator of claim 1, further comprising a wireless interface.

3. The weapon emulator of claim 1, wherein the weapon emulator is a gun and the firing indicator is a slide.

4. The weapon emulator of claim 3, wherein the slide is designed to move at least one inch relative to the body.

5. The weapon emulator of claim 1, further comprising a shell ejection mechanism that includes an electro-mechanical actuator designed to eject a shell casing.

6. The method of claim 1, further comprising the step of sensing the movement of a trigger to create a fire signal.

7. The method of claim 1, further comprising the step of causing a barrel tip locator inside the tip of the barrel to illuminate.

8. The method of claim 7, further comprising the step of editing the video to insert muzzle flashes in locations defined by the barrel tip locator.

9. The method of claim 7, wherein the barrel tip locator is a RGB light emitting diode.

10. The method of claim 7, further comprising causing the barrel tip locator to illuminate based on the calculated time.

11. The weapon emulator of claim 1, further comprising a firearm controller in data communication with both the shutter timing device and the weapon emulator wherein the firearm controller provides the shutter timing information in receives from the shutter timing device to the weapon emulator.

12. The weapon emulator of claim 11, wherein firearm controller syncs the weapon emulator with a master frame clock source.

13. The weapon emulator of claim 1, wherein the shutter timing device is based on a jam sync interface or a genlock interface.

14. A method of emulating a weapon firing comprising:

calculating a time to activate an electro-mechanical actuator so that a firing indicator on a weapon emulator is in motion when a camera shutter is open;

activating the electro-mechanical actuator coupled to the body of a weapon emulator at the calculated time; and causing a firing indicator coupled to the electro-mechanical actuator to move relative to the body of the weapon emulator.

15. The method of claim 14, further comprising ejecting a shell from the weapon emulator using an electro-mechanical actuator.

16. The method of claim 15, wherein the trajectory the shell is ejected is adjusted.

17. The method of claim 14, further comprising synchronizing actuation of body hit squids using the calculated time.

18. The method of claim 14, wherein the weapon emulator is a gun and the firing indicator is a slide and the electro-mechanical actuator moves the slide at least one inch relative to the body.

19. A method of simulating a firearm comprising:

calculating a time to simulate the firing of an electro-mechanical gun so that a slide on the electro-mechanical gun is in motion when a camera shutter is open;

activating an electro-mechanical actuator coupled to the slide of the electro-mechanical gun causing the slide to move relative to the electro-mechanical gun based on the calculated time; and causing a barrel tip locator inside a barrel of the electro-mechanical gun to illuminate based on the calculated time.

20. The method of claim 19, further comprising editing a movie to insert muzzle flashes in locations defined by the barrel tip locator.

* * * * *